US009359806B2

(12) United States Patent
Header

(10) Patent No.: US 9,359,806 B2
(45) **Date of Patent: *Jun. 7, 2016**

(54) COMBINATION MARINE AND STOP FRAME GLAZED PANEL AND METHOD FOR THE SAME

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/638,556

(22) Filed: Mar. 4, 2015

(65) Prior Publication Data

US 2015/0267460 A1 Sep. 24, 2015

Related U.S. Application Data

(63) Continuation-in-part of application No. 14/219,762, filed on Mar. 19, 2014, now Pat. No. 8,997,412.

(51) Int. Cl.

| | |
|---|---|
| ***E06B 3/54*** | (2006.01) |
| ***E06B 3/263*** | (2006.01) |
| ***E06B 1/52*** | (2006.01) |
| *E06B 3/30* | (2006.01) |
| *E06B 3/48* | (2006.01) |
| *E04B 2/88* | (2006.01) |
| *E06B 3/964* | (2006.01) |
| *E06B 3/968* | (2006.01) |

(52) U.S. Cl.

CPC ..... *E06B 3/26303* (2013.01); *E06B 1/524* (2013.01); *E04B 2/88* (2013.01); *E06B 3/305* (2013.01); *E06B 3/481* (2013.01); *E06B 3/9642* (2013.01); *E06B 3/9687* (2013.01); *Y10T 29/49826* (2015.01)

(58) Field of Classification Search

CPC ..... E04B 2/967; E04B 2/96; E06B 3/5427; E06B 3/5454; E06B 3/54; E06B 1/12; E06B 1/14; E06B 1/18

USPC ..... 52/204.71, 204.62, 204.67, 204.7, 52/204.705; 49/501, 504

See application file for complete search history.

(56) References Cited

U.S. PATENT DOCUMENTS

| | | | |
|---|---|---|---|
| 2,918,708 | A | 12/1959 | Sharp et al. |
| 3,299,596 | A | 1/1967 | Neal et al. |
| 3,388,517 | A | 6/1968 | Wohl et al. |
| 4,555,868 | A | 12/1985 | Mancuso |
| 4,621,478 | A | 11/1986 | Phillips et al. |
| 4,747,248 | A | 5/1988 | Fahs |
| 5,012,616 | A | 5/1991 | Martin |

(Continued)

OTHER PUBLICATIONS

SL 35 Detail Sections Folding Glass Door, Jun. 2010, Solarlux Aluminum Systeme GmbH, Germany.

SL 60e Detail Sections Folding Glass Door, Jan. 2013, Solarlux Aluminum Systeme GmbH, Germany.

(Continued)

*Primary Examiner* — Brent W Herring

(74) *Attorney, Agent, or Firm* — Stone Creek Services LLC; Alan M. Flum

(57) ABSTRACT

Disclosed is a framed glazed door or wall panel that can be utilized in applications requiring structural rigidity of the panel frame such as pivot doors, hinged doors, or glass folding doors, and a method for assembling the same. The panel includes marine glaze vertical frame members and horizontal stop glaze frame members. The vertical frame members and horizontal frame members can be rigidly joined by corner lugs inserted the body of the horizontal frame members and captively held on the surface of the vertical frame members.

6 Claims, 36 Drawing Sheets

(56) References Cited

U.S. PATENT DOCUMENTS

| | | | | |
|---|---|---|---|---|
| 5,042,212 | A | 8/1991 | Golen | |
| 5,544,457 | A * | 8/1996 | Labrecque | E06B 3/5835 52/204.69 |
| 5,761,860 | A | 6/1998 | Koike et al. | |
| 5,806,256 | A | 9/1998 | Byrne | |
| 6,829,868 | B1 | 12/2004 | Frey | |
| 7,138,166 | B2 | 11/2006 | Rinehart | |
| 7,416,772 | B2 * | 8/2008 | Rinehart | B32B 17/10036 428/99 |
| 2004/0234730 | A1 * | 11/2004 | Rinehart | B32B 17/10036 428/192 |
| 2004/0234731 | A1 | 11/2004 | Rinehart | |
| 2005/0055905 | A1 * | 3/2005 | Sayer | B01L 1/50 52/204.1 |

OTHER PUBLICATIONS

Gana Glazing Manual 50th Edition, pp. 135-136, p. 168 (bottom), 2009, Glass Association of North America.

Brent W Herring, Non Final Office Action, U.S. Appl. No. 14/219,762, "Combination Marine and Stop Glaze Frame Member," Applicant: Gregory Header, Date of Office Action: Nov. 3, 2014, United States Patent and Trademark Office, Alexandria, VA.

Brent W Herring, Notice of Allowance, U.S. Appl. No. 14/219,762, "Combination Marine and Stop Glaze Frame Member," Applicant: Gregory Header, Date of Notice: Jan. 29, 2015, United States Patent and Trademark Office, Alexandria, VA.

U.S. Appl. No. 14/219,762, "Combination Marine and Stop Glaze Frame Member," Applicant: Gregory Header, Filing Date: Mar. 19, 2014.

* cited by examiner

COMBINATION MARINE AND STOP FRAME GLAZED PANEL AND METHOD FOR THE SAME

CROSS REFERENCE TO RELATED APPLICATIONS

This application is a continuation-in-part of U.S. patent application Ser. No. 14/219,762 filed on Mar. 19, 2014. The entire contents of U.S. patent application Ser. No. 14/219,762 are hereby incorporated by reference.

BACKGROUND

The present disclosure relates to glazed door, windows, and wall structures. Specifically, the present disclosure relates to glazed door, window, and wall panels with structurally supporting frames.

Framed and glazed door and wall structures can be found in both commercial and residential environments, for example, framed glass pivot doors, swing doors, sliding glass doors, or folding glass doors. Two common types of framed glass panels are marine glazing and stop glazing. Marine glazing generally utilizes a marine glazing gasket, which wraps around the edge of the glass and is held in a u-shaped channel within the glazing frame. Stop glazing utilizes glazing stops that slide, snap, or otherwise attach to the glazing frame on either side of the glass panel in order to hold the glass panel within the frame.

Marine glazed frames often have a narrower frame profile than stop glazing frame systems due to the nature of the frame's construction. However, marine glazing system frames often lack rigidity. These systems typically rely on fasteners engaged into screw bosses. Marine glazing is commonly used in applications where the weight of both the frame and the glass, is center supported where corners stiffness is not required. Marine glaze systems are often used in applications such as top load and/or bottom load sliding doors, fixed glass panels, and other similar applications. In contrast, stop glazing systems achieve their rigidity by utilizing a made to fit extruded lugs which enables the system to transfer forces from one frame element to another in a more efficient and economical way allowing a broader list of applications. Stop glazing systems are often used in eccentric systems such as hinged swing glass doors, pivot glass doors, folding doors, and others.

SUMMARY

The inventor desired to achieve a vertical frame narrower than conventional stop glaze doors structures for applications that could benefit from a structurally rigid frame such as pivot glass doors, hinged glass doors, and glass folding doors. After many months of trial and error, the inventor recognized that a narrower vertical frame profile could be achieved for applications benefiting from a structurally rigid frame, by combining marine type glazing vertical frame members with stop glaze horizontal frame members or alternatively, by combining a modified marine type glazing vertical frame member with stop glaze horizontal frame members.

One of the challenges faced by the inventor was how to join the vertical marine glaze frame members and horizontal stop glaze frame members together and create a structurally rigid frame capable of supporting the glazed framed door panel for applications such as pivot doors, hinged doors, and glass folding doors. The inventor recognized that such a structurally rigid frame could be realized by utilizing a lug that engages the inward facing exterior surface of the vertical marine glaze frame member and at the same time engages and secured a hollow interior portion of the horizontal stop glaze frame member. This arrangement creates a rigid corner joint between the horizontal stop glaze frame member and the vertical marine glaze frame member. Because the lug is secured to the outside surface of the vertical marine glaze frame member, the corner joint does not rely on the face width or interior structure of the vertical marine glaze frame member. This allows for the possibility of creating a narrow vertical marine glaze frame member front face while maintaining a corner joint with sufficient structural integrity so that the frame itself is rigid enough to support the door or wall panel.

The surface engagement between the lug and the vertical marine glaze frame member can be accomplished by captively and slidably engaging the lug lengthwise along the inward facing exterior surface of the vertical marine glaze frame member. For example, the lug can include one or more vertical ridges, the vertical ridges can captively engage corresponding one or more lengthwise slots along the inward facing exterior surface of the vertical marine glaze frame member. Alternatively, the lug can be constructed that is secured directly to the surface of the vertical marine glaze frame member without captive slidable engagement.

The glass panel can seat directly on both the horizontal stop glaze frame members and in a u-shaped channel within the vertical marine glaze frame members with cushioning material as an intermediary between the glass panel edge and the frame members. The intermediary cushioning material can be setting blocks secured to horizontal stop glaze frame members face and within the base of u-shaped channel of the vertical marine glaze frame members. Alternatively, the intermediary cushioning material for the marine glaze horizontal frame member can be a wrap-around marine glazing gasket or similar gasketing material.

This Summary has introduced a selection of concepts, in simplified form, that is described further in the Description to give the reader an overview of the disclosed subject matter. The Summary is not intended to identify essential features or limit the scope of the claimed subject matter.

DRAWINGS

DESCRIPTION

The terms "left", "right", "top", "bottom", "upper", "lower", "vertical", "horizontal", "front", "back", and "side" are relative terms used throughout the disclosure to aid in the understanding of the figures. Unless otherwise indicated, these terms are not used to denote absolute direction, or orientation. They are not meant to imply a particular preference or limitation for a particular orientation or direction. In addition, measurements, including widths, are given throughout this disclosure. These measurements are given to help the reader understand the scale and advantage of the present disclosure. It should be understood by the reader that any dimension given is typical, other widths and heights are possible, and the claimed invention is in no way limited to any measurements, widths, or ranges recited in the Description.

Figure 1:
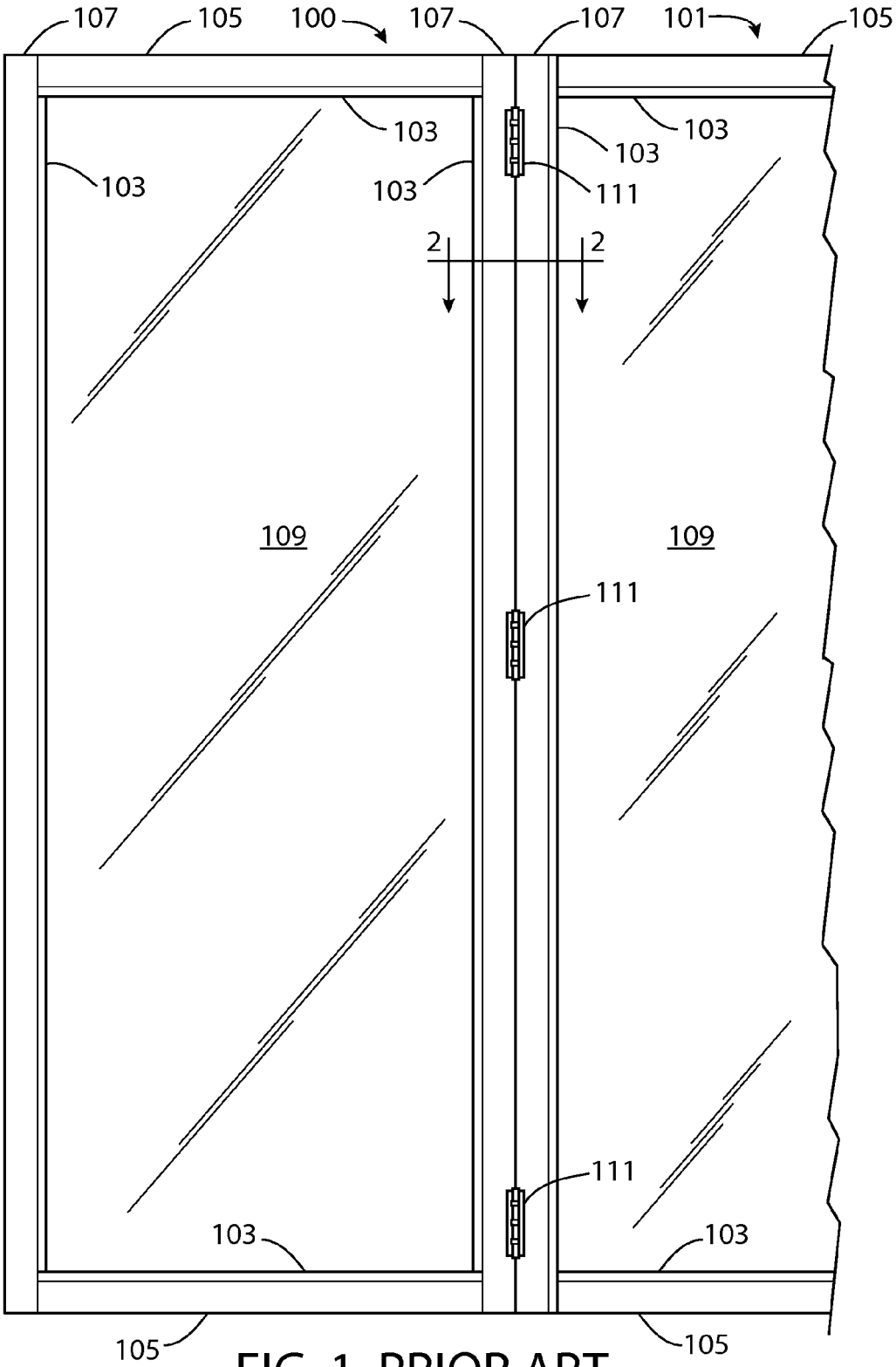
FIG. 1 PRIOR ART
FIG. 1 illustrates a stop glaze framed door panel and a portion of a second stop glazed framed door panel in the prior art.

The following description is made with reference to figures, where like numerals refer to like elements throughout the several views. FIG. 1 illustrates a stop glaze framed door panel 100 and a portion of a second stop glazed framed door panel 101 in the prior art. Both the stop glaze framed door panel 100 and the second stop glazed framed door panel 101 utilize glazing stops 103 attached to horizontal stop glaze frame members 105, vertical stop glaze frame members 107, and surrounding each glass panel 109. The stop glaze framed door panel 100 and the second stop glazed framed door panel 101 are joined together along the vertical stop glaze frame members 107 by hinges 111.

Figure 2:
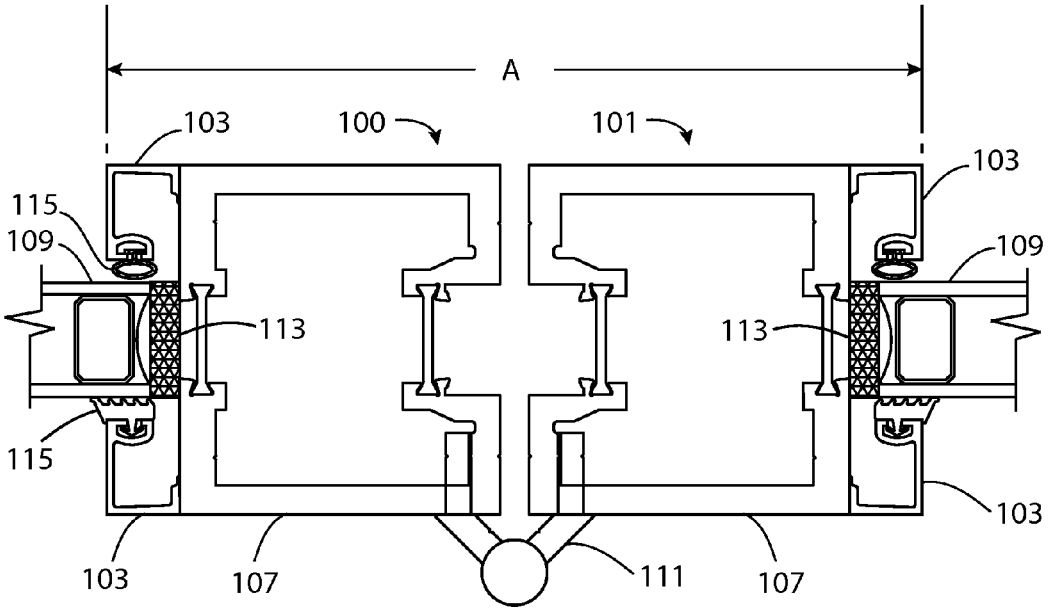
FIG. 2 PRIOR ART
FIG. 2 illustrates a cross sectional view of the stop glazed framed door panel and the portion of the second stop glazed framed door panel of FIG. 1 taken along section lines 2-2.

FIG. 2 illustrates a cross sectional view of the stop glaze framed door panel 100 and the second stop glazed framed door panel 101 of FIG. 1 taken along section lines 2-2. The width of the vertical stop glaze frame members 107 joined between the stop glaze framed door panel 100 and the second stop glazed framed door panel 101 together in the closed position is represented by the letter "A." Measurement A typically is 5 inches (0.127 m) to 8 inches (0.203 m). FIG. 2 shows the relationship between the glazing stops 103, the glass panel 109 and each of the stop glaze framed door panel 100 and the second stop glazed framed door panel 101. The stop glaze framed door panel 100 and the second stop glazed framed door panel 101 are shown joined by the hinges 111. Both the stop glaze framed door panel 100 and the second stop glazed framed door panel 101 are structured to create a thermal break between the outside and inside of the door panels.

In FIG. 2, the glass panel 109 is seated above the top surface of the vertical stop glaze frame member 107. The glass panel 109 rests on setting blocks 113. The glass panel 109 is held vertically in place along the vertical stop glaze frame member 107 by the glazing stops 103. The glazing stops 103 snap into the vertical stop glaze frame members 107. The glazing stops 103 include a gasket 115 that comes in direct contact with the glass panel 109 and provide a cushioned seating surface for the glass panel 109.

The setting blocks 113 are typically made of silicone, thermoplastic, ethylene propylene diene monomer (EDPM), or neoprene. Setting blocks 113 typically have a hardness of 85±5 Shore A durometer.

Figure 3:
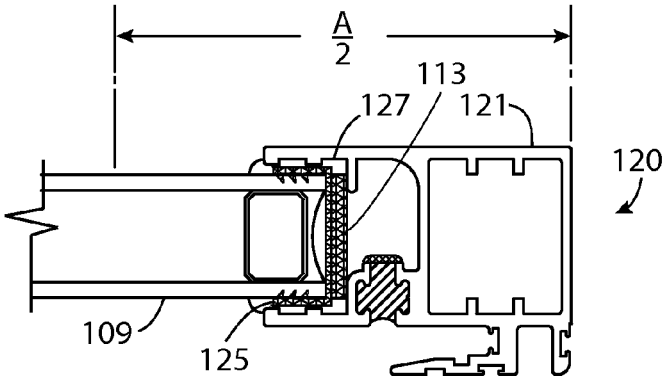
FIG. 3 PRIOR ART
FIG. 3 illustrates a sectional view taken along lines 3-3 in FIG. 5.
Figure 4:
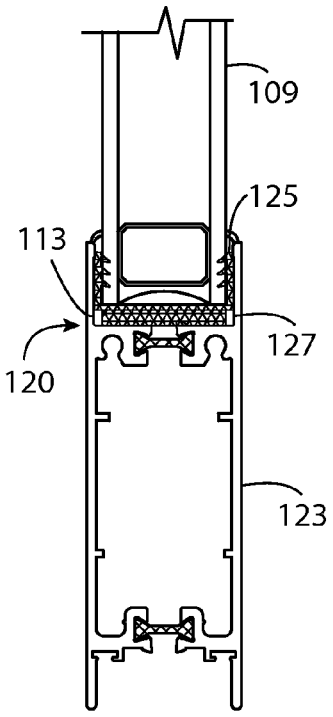
FIG. 4 PRIOR ART
FIG. 4 illustrates a sectional view taken along lines 4-4 in FIG. 5.
Figure 5:
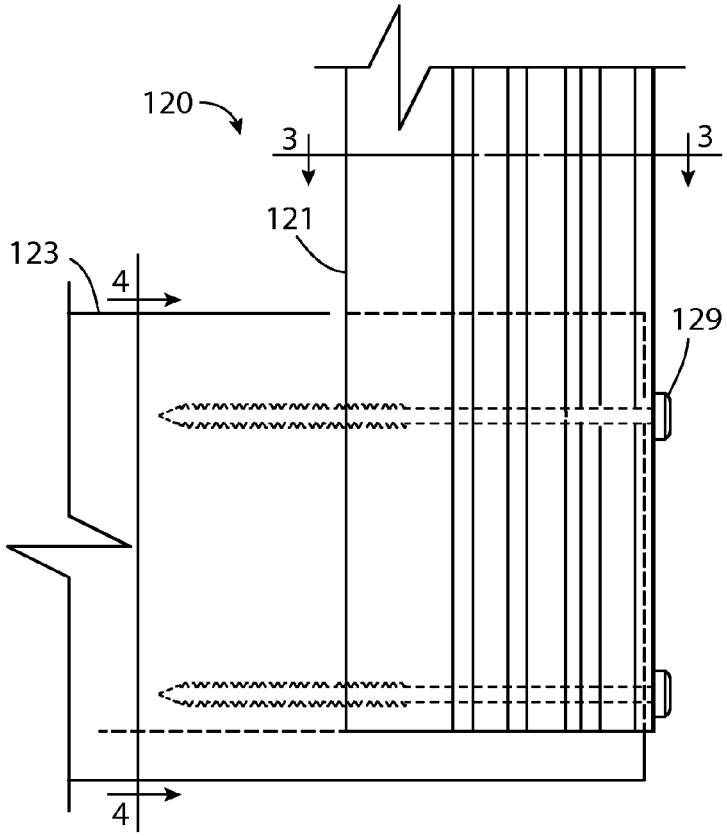
FIG. 5 PRIOR ART
FIG. 5 illustrates a front detail view of the corner connection of the marine glaze framing system.

In order to further aid the reading in understanding the differences between a stop glazed style frame and a marine glaze style frame, FIGS. 3-6 illustrate a corner connection detail of a typical of a marine glaze framing system 120 in the prior art. FIG. 3 illustrates a sectional view taken along lines 3-3 in FIG. 5. FIG. 4 illustrates a sectional view taken along lines 4-4 in FIG. 5. FIG. 5 illustrates a front detail view of the corner connection of the marine glaze framing system 120. The marine glaze framing system 120 of FIGS. 3-5 include a vertical marine glaze frame member 121 and a horizontal marine glaze frame member 123. In FIGS. 3-4, marine glaze gaskets 125 wrap-around the edge of the glass panel 109 between the glass panel 109 and seat within a glazing channel 127 of either the vertical marine glaze frame member 121 of FIG. 3 or the horizontal marine glaze frame member 123 of FIG. 4. In contrast, the stop glaze framed door panel 100 of FIGS. 1-2, the glass panel 109 is set at or above the horizontal stop glaze frame member 105 body and held in place by the glazing stops 103. In both FIGS. 3 and 4, the marine glaze gasket 125 that surrounds the edge of the glass panel 109 is shown resting directly against a setting block 113. The setting block 113 rests directly against the vertical marine glaze frame member 121 of FIG. 3 and the horizontal marine glaze frame member 123 in FIG. 4. For FIG. 3, the marine glaze gasket 125 can alternatively rest directly against the vertical marine glaze frame member 121. For FIG. 4, the marine glaze gasket 125 can alternatively rest directly against the horizontal marine glaze frame member 123 without the setting block 113. Like the stop glaze framed door panel 100 illustrated in FIGS. 1-2, the both the vertical marine glaze frame member 121 and the horizontal marine glaze frame member 123 include thermal breaks in order to insulate the inside environment from the outside temperature. A marine glazing system can potentially have a narrower profile than a stop glaze system. This is illustrated by distance A/2 in FIG. 3, which represents the width of the vertical stop glaze frame member 107 of FIG. 2.

Figure 6:
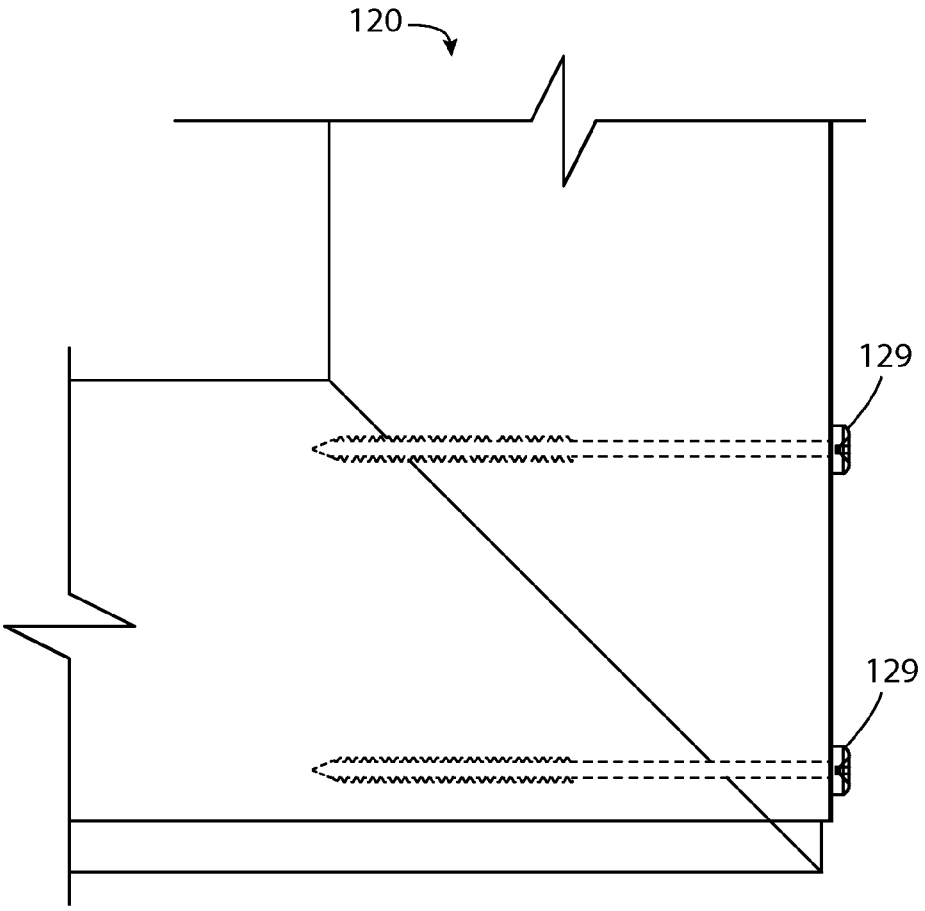
FIG. 6 PRIOR ART
FIG. 6 illustrates a front detail view of an alternative corner connection of a marine glaze framing system, using mitered corners, in the prior art.

Marine glaze framing systems 120, such as those illustrated in FIGS. 3-4 often depend on the structural integrity of the glass panel 109, because the frames are not rigid. FIG. 5 illustrates how the vertical marine glaze frame member 121 and the horizontal marine glaze frame member 123 are typically fastened by sheet metal screws 129 using a butt joint. FIG. 6 illustrates a front detail view of an alternative corner connection of the marine glaze framing system 120 using mitered corners, and using sheet metal screws 129 to maintain the corner connection, in the prior art. The corner connections illustrated in both FIGS. 5 and 6, typical of marine glaze systems, have limited structural rigidity. In general, the limited structural rigidity of the marine glaze systems, typical in the art, makes them suitable for supported applications such as fixed door panels or horizontal sliding glass doors or wall panels.

Figure 7:
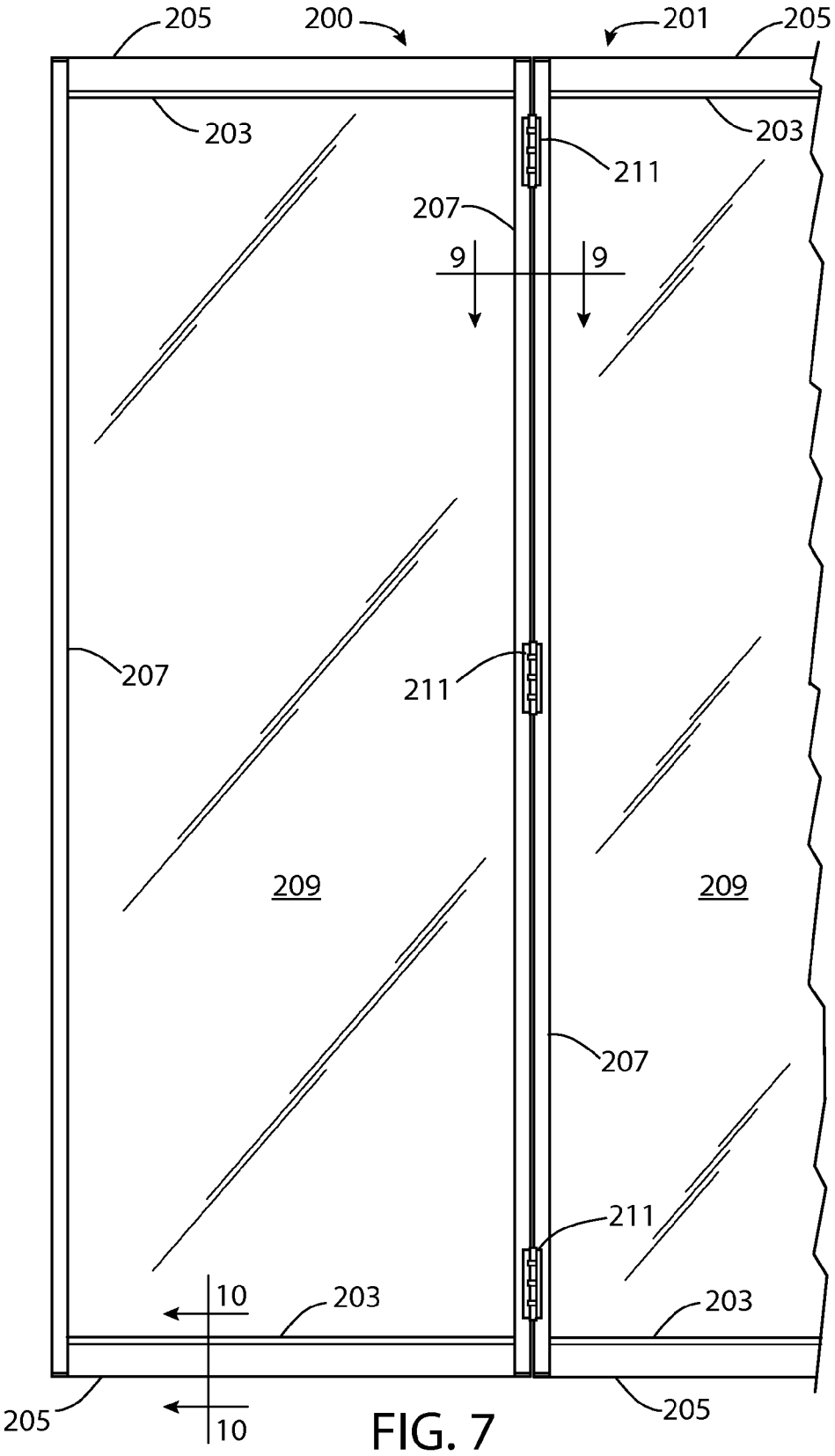
FIG. 7 illustrates, a front view, of a glazed frame door panel and a portion of a second glazed frame door panel, of the present disclosure, including horizontal stop glaze frame members, and vertical marine glaze frame members.
Figure 8:
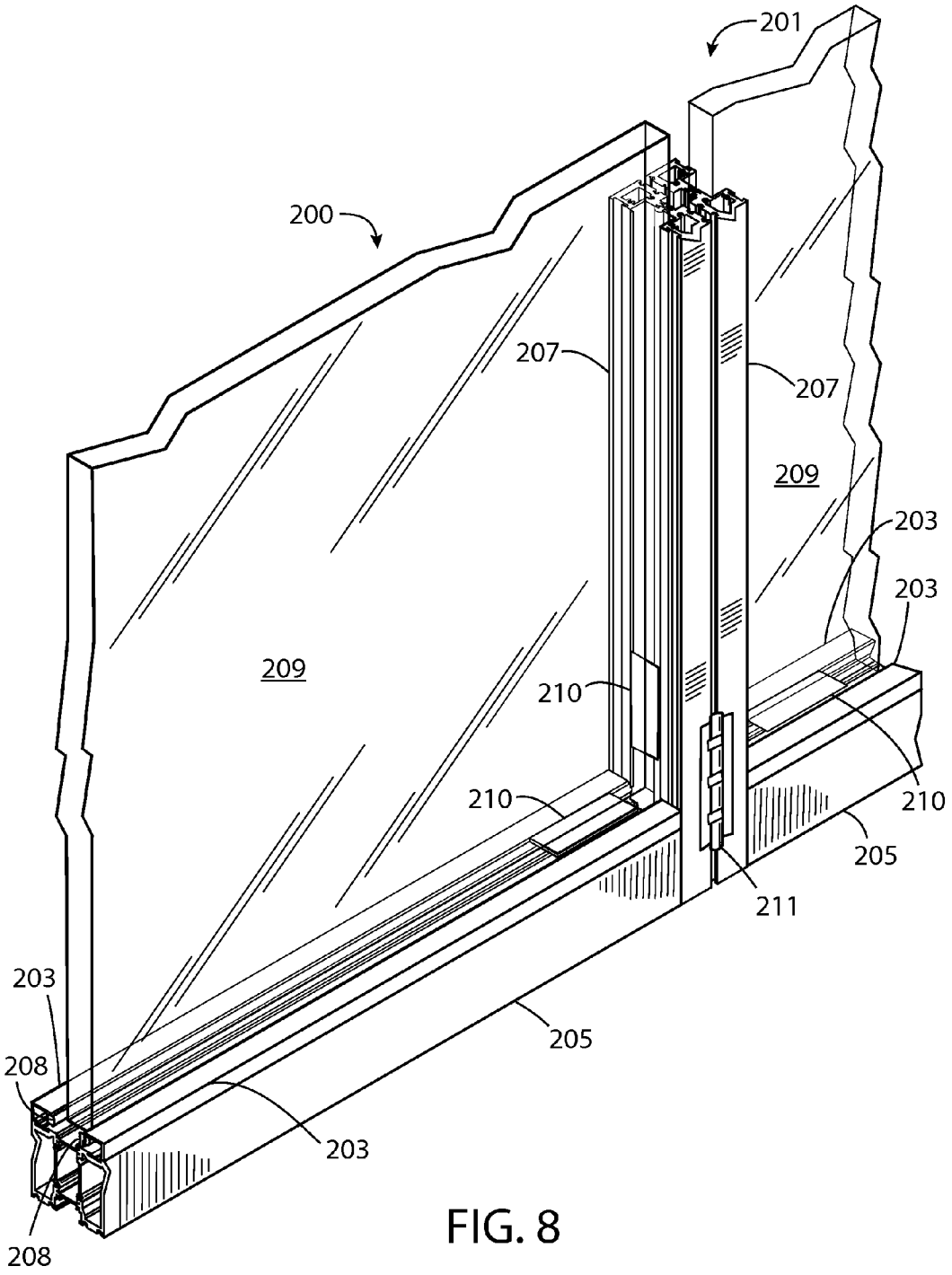
FIG. 8 illustrates the lower right hand portion of the glazed frame door panel of FIG. 7.

The inventor desired to achieve a vertical frame narrower in front and rear profile than conventional stop glaze doors structures, such as those in FIGS. 1-2 for applications requiring structurally rigid frame. After many months of trial and error, the inventor recognized that a narrower vertical frame profile could be achieved for pivot doors, hinged doors, glass folding doors, or other applications requiring a structurally rigid frame, by combining marine type glazing vertical frame members with stop glaze horizontal frame members. This approach has the advantage of the structural stability of a horizontal stop glaze frame members while maintaining a narrow profile for the vertical frame member. FIG. 7 illustrates a front view, and FIG. 8 lower right hand portion perspective view, of a glazed framed door panel 200 and a portion of a second glazed framed door panel 201, of the present disclosure, including horizontal stop glaze frame members 205, and vertical marine glaze frame members 207. The horizontal stop glaze frame members 205 include glazing stops 203. The glazing stops 203 include a glazing stop gasket 208. The vertical marine glaze frame members 207 surround corresponding vertical edges of the glass panel 209. The horizontal stop glaze frame members 205 in combination with the glazing stops 203 surround corresponding horizontal edges of the glass panel 209. In FIG. 8, the glass panel 209 edges rest directly against an intermediary cushioning material, in this case, setting blocks 210. Setting blocks 210, in turn, rest directly against the vertical marine glaze frame members 207 and the horizontal stop glaze frame members 205. The glass panel 209 is vertically aligned by the glazing stops 203. The glazing stops 203 are removably and rigidly connected to the horizontal stop glaze frame members 205. The glass panel 209 front and back faces rest directly against a corresponding glazing stop gasket 208. In FIGS. 7-8, the glazed framed door panel 200 and the portion of a second glazed framed door panel 201 are joined by hinges 211 as typical of a framed folding glass door or, alternatively, a swing door.

Figure 9:
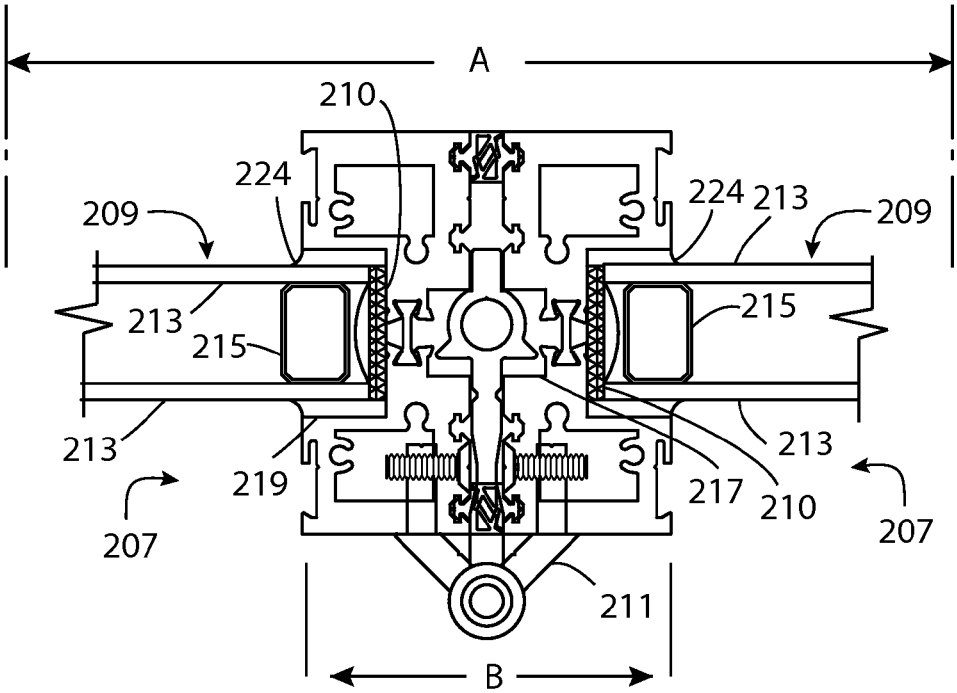
FIG. 9 illustrates a sectional view of the vertical marine glaze frame members adjoining in FIG. 7 taken along section lines 9-9.

FIG. 9 illustrates a sectional view of the vertical marine glaze frame members 207 adjoining in FIG. 7 taken along section lines 9-9 illustrating the vertical marine glaze frame members 207 joined by the hinges 211. The width of the vertical marine glaze frame members 207 adjoining from glazed framed door panel 200 and the second glazed framed door panel 201 of FIG. 7 together are represented by measurement B. Measurement B can typically be 2.5 inches (0.0635 m) for a standard height door, but can be wider or narrower depending on material strength, door height and required structural rigidity. This is significantly narrower than measurement A from FIG. 2, which can typically be 7 inches (0.178 m). FIG. 9 illustrates the glass panels 209 that each include two plates of glass 213 separated by spacers 215. The front and back of each of the vertical marine glaze frame members 207 includes a thermal break formed by an internal cavity 217 within each of the vertical marine glaze frame members 207. The thermal break is generally for exterior doors not generally required for most interior doors. The edge of the glass panels 209 is seated in longitudinal slots or u-shaped channels 219 formed inward from the surface of vertical marine glaze frame members 207. A modified marine glaze system is illustrated in FIG. 9. The ends of each of the glass panels 209 engage the back of the u-shaped channels 219 with the setting block 210 as an intermediary. Structural glazing sealant 224 surround and secure the portions of the front and back faces of the glass panel 209 that are seated within the u-shaped channel 219. Structural glazing sealants 224 are often made of high-strength elastomeric sealant, for example silicone structural glazing sealants. Structural glazing sealants 224 are known in the art as sealants that in addition to providing a weather barrier against air and moisture also provide structure support and attachment of glass panels 209 and other components to glazing framing systems.

Figure 10:
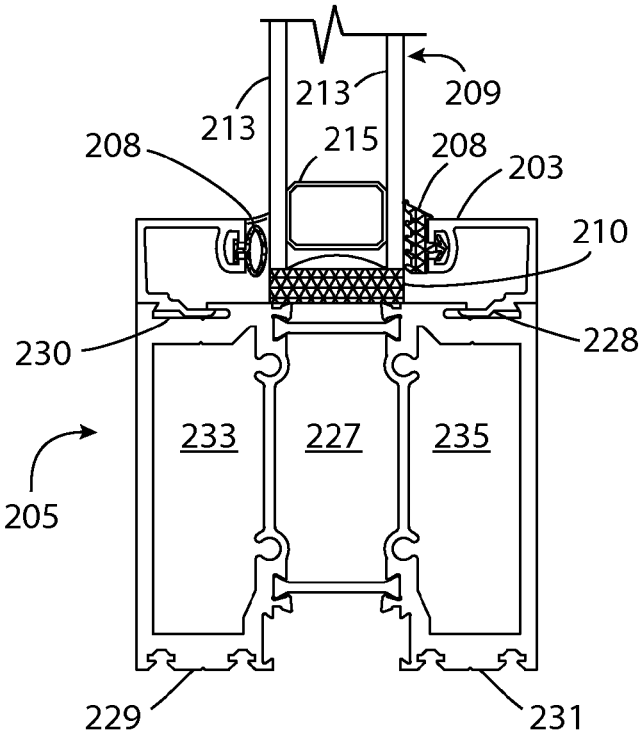
FIG. 10 illustrates a sectional view of the horizontal stop glaze frame member of FIG. 7 taken along section lines 10-10 in FIG. 7 showing the glass panel in relation to the glazing stops.

FIG. 10 illustrates a sectional view of the horizontal stop glaze frame member 205 of FIG. 7 taken along section lines 10-10 in FIG. 7 showing the glass panel 209 in relation to the glazing stops 203. The horizontal bottom edge of the glass panel 209 rests against setting blocks 210. This holds the glass panel 209 above the top surface of horizontal stop glaze frame member 205. The glazing stops 203 hold the glass panel 209 securely in place. This arrangement allows the glass panel 209 to be inserted and removed when the glazing stops 203 are removed from the horizontal stop glaze frame member 205. Each glazing stop 203 includes the glazing stop gasket 208. The glazing stop gasket 208 rests directly against the front and rear faces of the glass panel 209. The glazing stops 203 are removably and rigidly attachable to the horizontal stop glaze frame member 205. In FIG. 10, the glazing stops 203 are shown as snapping into horizontal stop glaze frame member 205 by a slot 230 in the top surface of the horizontal stop glaze frame member 205 and by a tab 228 in the bottom of the body of the glazing stop 203. This attachment arrangement is merely used for illustration. Other structures for attaching the glazing stops 203 are readily known to those skilled in the art.

As with the vertical marine glaze frame member 207, each of the plates of glass 213 making up the glass panel 209 is separated by the spacer 215. The horizontal stop glaze frame member 205 includes a thermal break formed by a cavity 227 between a first section 229 and a second section 231 of the horizontal stop glaze frame member 205. The first section 229 includes a first section hollow interior portion 233 and the second section hollow interior portion 235 extending longitudinally along the horizontal stop glaze frame member 205.

Figure 11:
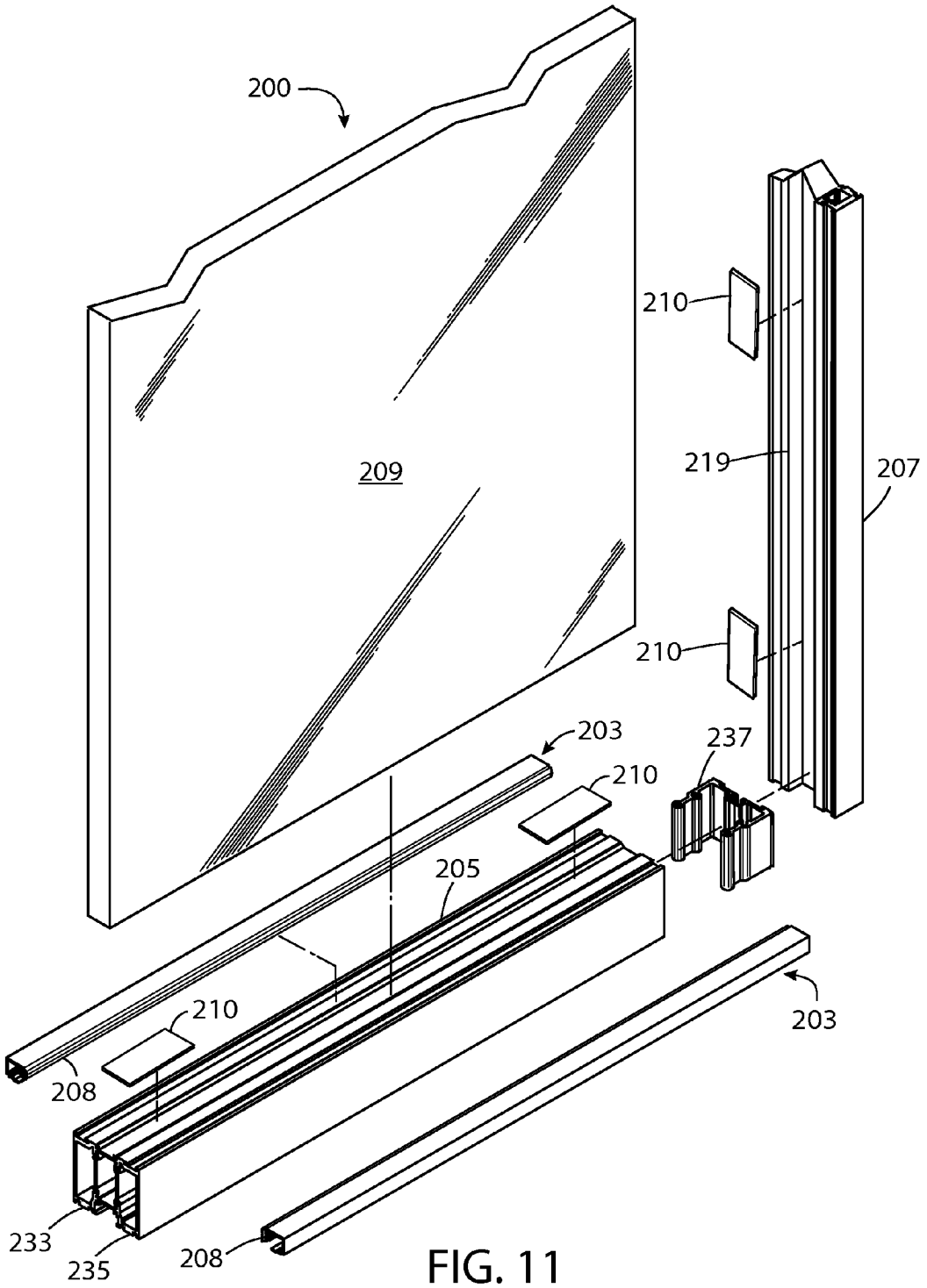
FIG. 11 illustrates exploded view of the lower right hand portion of the glazed framed door panel of FIG. 7.

FIG. 11, which is an exploded view of the lower right hand portion of the glazed framed door panel 200 of FIG. 7, further illustrates the glass panel 209, glazing stops 203, horizontal stop glaze frame members 205, and vertical marine glaze frame members 207. The setting blocks 210 oriented horizontally are shown in relation to their respective horizontal stop glaze frame member 205 and the bottom edge of the glass panel 209. The setting blocks 210 oriented vertically are shown in relation to vertical edge of the glass panel 209 and the u-shaped channel 219 of the vertical marine glaze frame members 207.

Figure 13:
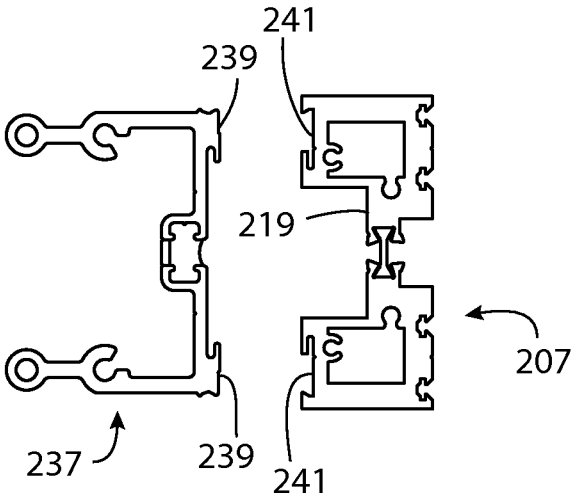
FIG. 13 illustrates a top exploded view of the lug and vertical marine glaze frame member of FIG. 12.
Figure 14:
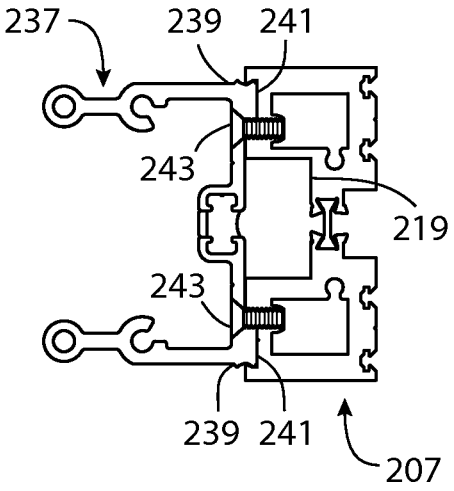
FIG. 14 illustrates a top assembled view of lug and vertical marine glaze frame member of FIG. 12.
Figure 15:
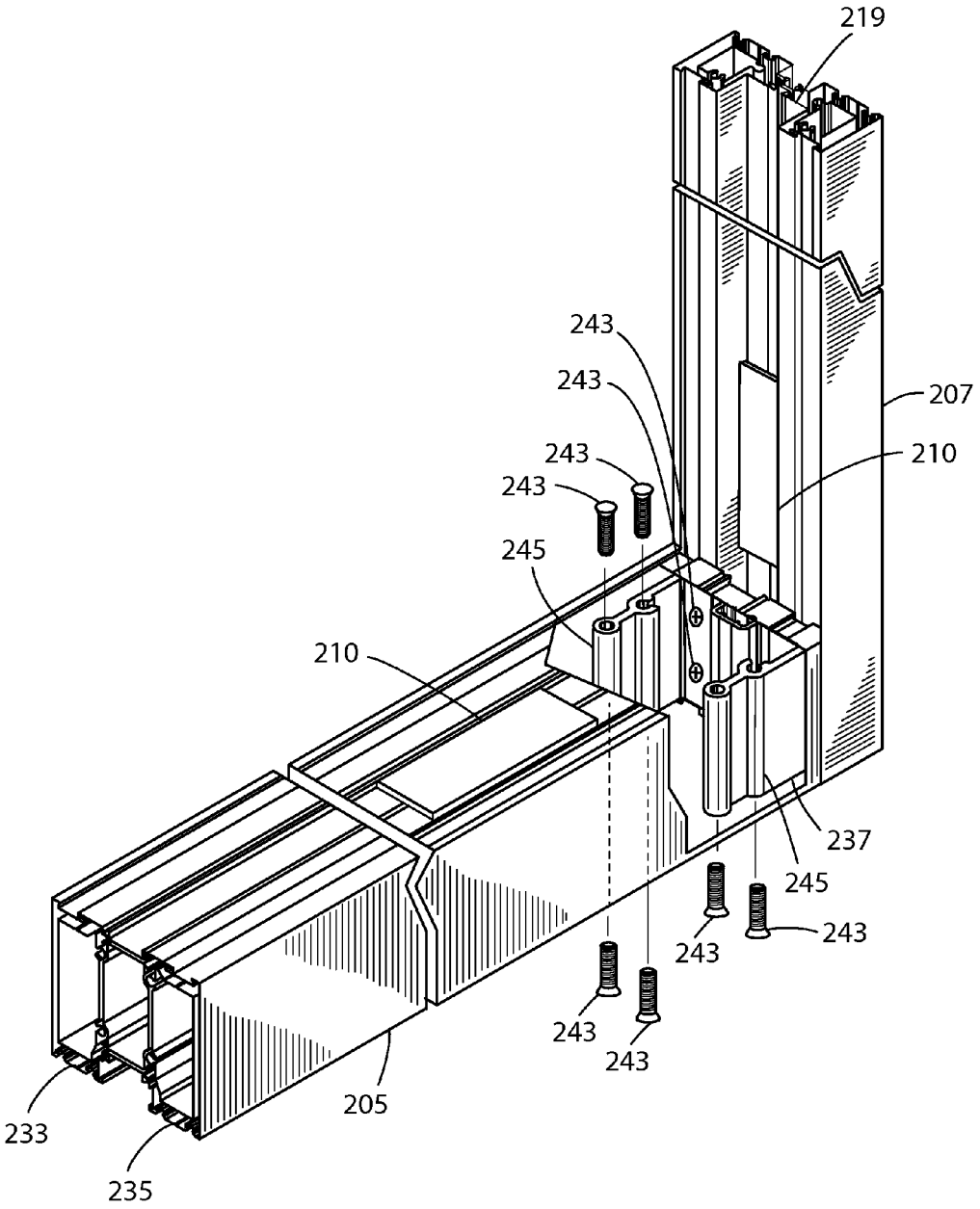
FIG. 15 illustrates the right vertical frame member and lower horizontal frame member of FIG. 7. The horizontal frame member is shown in partial cutaway to reveal the relationship between the lug and frame members.

One of the challenges faced by the inventor when combining the vertical marine glaze frame members 207 and horizontal stop glaze frame members 205 of FIGS. 7-8, was how to join the members together in order to create a structurally rigid frame capable of supporting the glazed framed door panel 200 for applications such as pivot doors, hinged doors, and glass folding door. Referring to FIGS. 11-15, the inventor recognized that a structurally rigid frame capable of supporting the glazed framed door panel 200 for applications such as pivot doors, hinged doors, and glass folding door could be realized by utilizing a lug 237 that engaged the inward facing outer surface of the vertical marine glaze frame member 207 and at the same time, as shown in FIGS. 11 and 15, engaged and secured to the horizontal stop glaze frame member 205 through the first section hollow interior portion 233 and the second section hollow interior portion 235.

Figure 12:
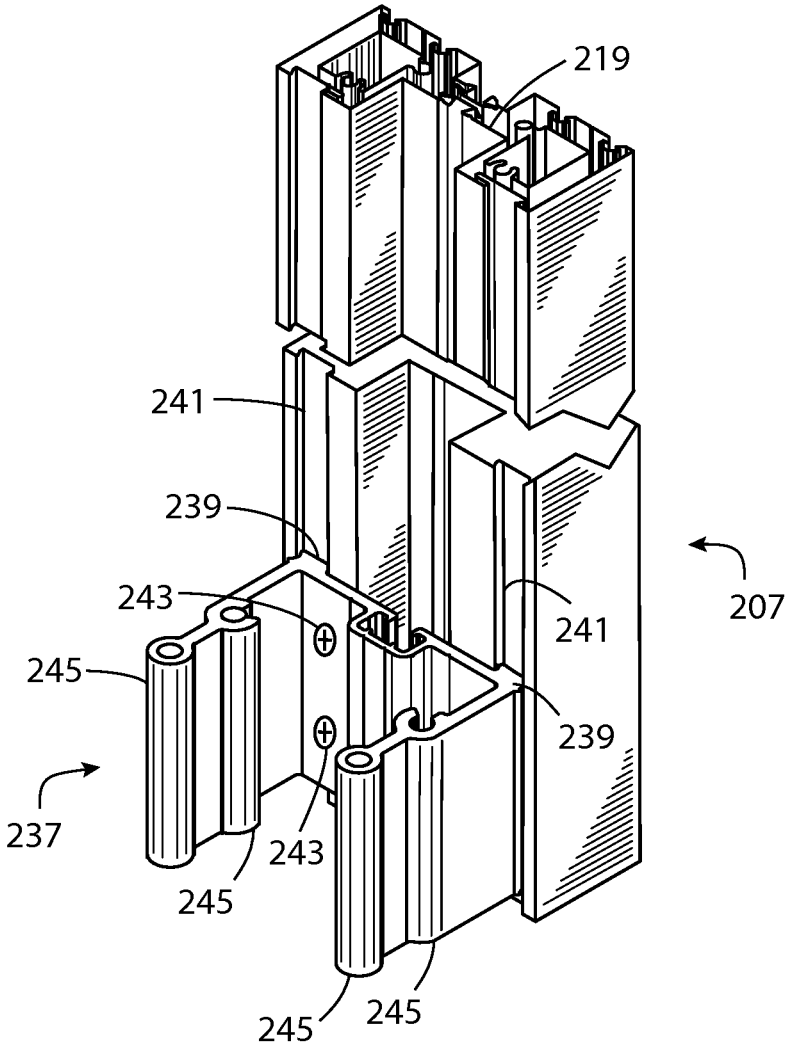
FIG. 12 illustrates a detail view of the vertical marine glaze frame member of FIG. 7 showing a lug attached.

FIG. 12 illustrates a detail view of the portion of the vertical marine glaze frame member 207 of FIG. 7 showing a lug 237 attached. FIG. 13 illustrates a top exploded view of the lug 237 and vertical marine glaze frame member 207 of FIG. 12. FIG. 14 illustrates a top assembled view of lug 237 and vertical marine glaze frame member 207 of FIG. 12. Referring to FIGS. 12-14, the lug 237 includes one or more ridges 239 that engage a corresponding one or more slots 241 on the surface of the vertical marine glaze frame members 207. Illustrated, are ridges 239 vertically oriented along opposing edges of the back surface of the lugs 237 and a pair of slots 241 corresponding to the position of the ridges 239 on either side of the u-shaped channel 219 on the inward facing surface of the vertical marine glaze frame member 207. The ridges 239 and the slots 241 are so shaped so that the lug 237 and the vertical marine glaze frame members 207 can be slid together but captively engaged. In FIG. 13, each ridge 239 has a shape complementary to its corresponding slot 241 in the sense that the ridge 239 and slot 241 are engaged in one slidable degree of freedom along the length of the vertical marine glaze frame member 207. In FIG. 13, the width of the cavity of the slot 241 is wider than the slot 241 opening on the surface of the vertical marine glaze frame member 207. Similarly, the base of the ridge 239 is narrower than the projected portion of the ridge 239. In FIG. 14, once slid together, the lug 237 and the vertical marine glaze frame members 207 are secured by threaded fasteners 243.

FIG. 15 illustrates the right vertical frame member and lower horizontal frame member of FIG. 7. The horizontal stop glaze frame member 205 is shown in partial cutaway to reveal the relationship between the lug 237, the horizontal stop glaze frame member 205, and the vertical marine glaze frame member 207. Also illustrated is setting block 210 that is vertically oriented and seated on the bottom of the u-shaped channel 219 of the vertical marine glaze frame member 207. The setting block 210 that is horizontally oriented is illustrated resting the horizontal stop glaze frame member 205 with a portion either even with or projecting above the top surface of the horizontal stop glaze frame member 205. The lug 237 portion extending from the vertical marine glaze frame member 207 and lug 237 assembly is slide into the first section hollow interior portion 233 and the second section hollow interior portion 235. Threaded fasteners 243 secure to bosses 245 in the lug 237, in both FIGS. 12 and 15, and thereby secure the horizontal stop glaze frame member 205 to the vertical marine glaze frame member 207 and lug 237 assembly. This arrangement creates a structurally rigid frame suitable for non-supported applications such as a pivot door, swing door, or folding glass door.

Figure 16:
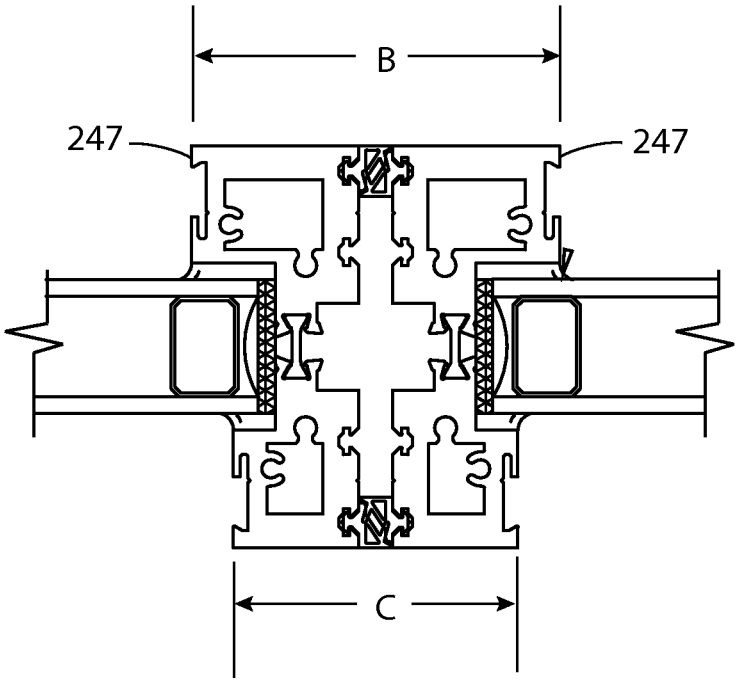
FIG. 16 illustrates, in sectional view, an alternative vertical marine glaze frame members adjoining in FIG. 7 that can typically be used in a fixed glass wall or fixed lite application.
Figure 17:
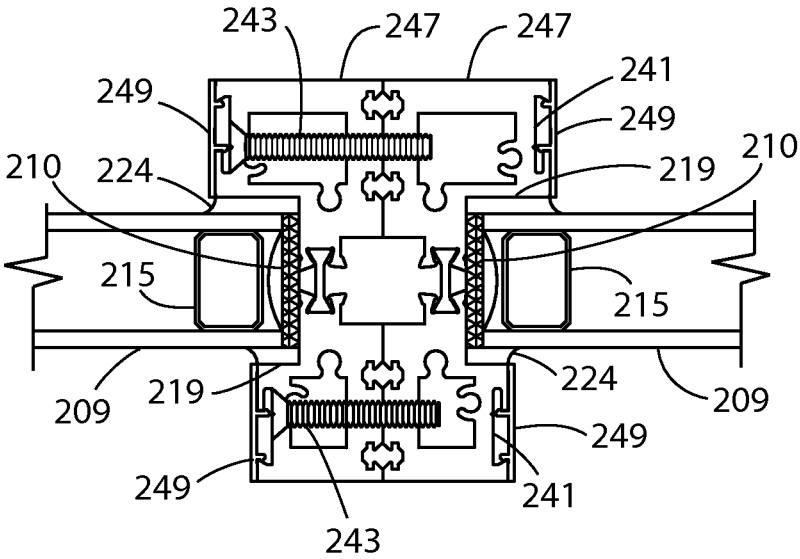
FIG. 17 illustrates, in sectional view, alternative vertical marine glaze frame members 247 adjoining in FIG. 16 with threaded fasteners to secure each of the alternative vertical marine glaze frame members and cover strips.

The vertical marine glaze frame members 207 of FIG. 9 is shown as an example in order to aid in the understanding of the present disclosure. FIGS. 16-19 illustrate other variations of vertical marine glaze frame members 207 of the present disclosure. FIGS. 16-17 illustrates, in sectional view, an alternative vertical marine glaze frame members 247 adjoining in FIG. 7 that can typically be used in a fixed glass wall or fixed lite application. FIG. 16 shows the adjoining inside faces of the alternative vertical marine glaze frame members 247 is illustrated with the same profile width B as the vertical marine glaze frame member 207 of FIG. 7 but the adjoining outside faces of the alternative vertical marine glaze frame members 247 is illustrated with a narrower width indicated by measurement C. While the inside face of the alternative vertical marine glaze frame member 247 is illustrated with profile width B, the profile width can be adjusted to meet aesthetic and architectural requirements. For example, the width could be width C or even narrower than width C if desired.

FIG. 17 further illustrates, alternative vertical marine glaze frame members 247 adjoining in FIG. 16 with threaded fasteners 243 to secure each of the alternative vertical marine glaze frame members 247 and cover strips 249. The cover strips 249 can snap on, slide in, or otherwise attach to the slots 241. The cover strips 249 can cover the portions of the slots 241 not engaged by the lug 237 of the previous figures. This can help to create a more aesthetic appearance. The alternative vertical marine glaze frame members 247 are constructed similarly to the vertical marine glaze frame members 207 of FIG. 7. Illustrated in FIG. 17 are the glass panel 209, spacer 215, u-shaped channel 219, setting blocks 210, and structural glazing sealant 224. The u-shaped channel 219 and the slots 241 in FIG. 17 can be similar configured as the u-shaped channel 219 and slots 241 of FIG. 15 so that there can be a commonality of parts shared between the two designs such as the lug 237 and the horizontal stop glaze frame member 205.

Figure 18:
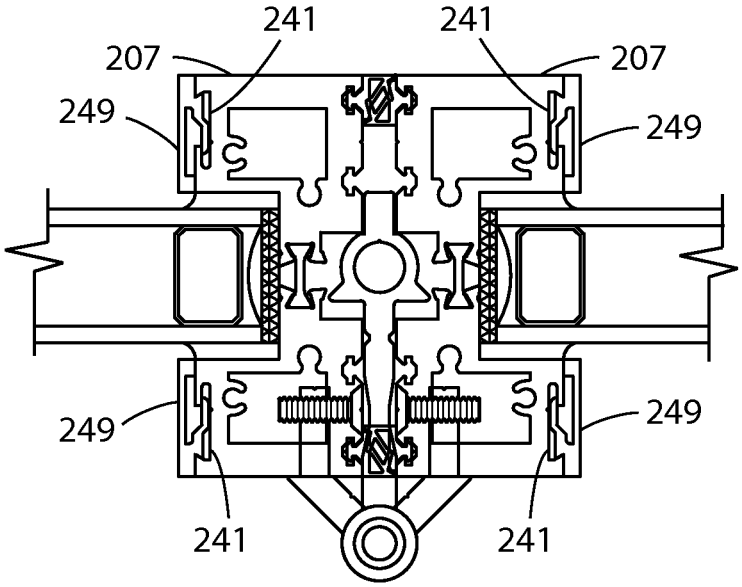
FIG. 18 illustrates the vertical marine glaze frame member of FIG. 9 with cover strips.

As in the FIG. 17, the vertical marine glaze frame members 207 of FIG. 9 can have trim added to create a more aesthetic appearance. FIG. 18 illustrates the vertical marine glaze frame members 207 of FIG. 9 with cover strips 249. As previously described, the cover strips 249 can snap on, slide in, or otherwise attach to the slots 241. The cover strips 249 can cover the portions of the slots 241 not engaged by the lug 237.

Figure 19:
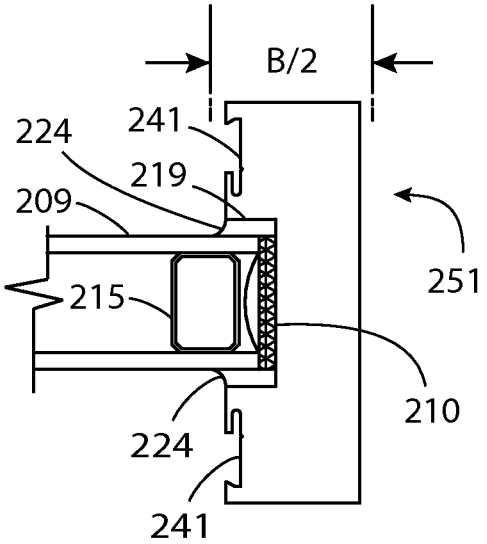
FIG. 19 illustrates, in sectional view, a second alternative vertical marine glaze frame member that can be utilized in non-thermally critical application.

The vertical marine glaze frame member 207 of FIG. 7 and alternative vertical marine glaze frame member 247 of FIGS. 16-17 all include thermal breaks suitable for protecting the inside of a building from the outside elements. FIG. 19 illustrates, in sectional view, a second alternative vertical marine glaze frame member 251 that can be utilized in non-thermally critical application, for example, in warm climates, or where minimizing the vertical site line is more important than thermal isolation. Because the second alternative vertical marine glaze frame member 251 does not have a thermal break, the structure is simplified and an even thinner front and back face profile can be realized. This is illustrated by the measurement B/2 which represents the width of one of the vertical marine glaze frame members 207 of FIG. 9 and is wider than the width of the second alternative vertical marine glaze frame member 251. The second alternative vertical marine glaze frame members 251 are constructed similarly to the vertical marine glaze frame members 207 of FIG. 9. Illustrated in FIG. 19 are the glass panel 209, spacer 215, u-shaped channel 219, setting blocks 210, and structural glazing sealant 224. As previously described for FIG. 17, the u-shaped channel 219 and the slots 241 in FIG. 19 can be similar configured as the u-shaped channel 219 and slots 241 of FIG. 15 so that there can be a commonality of parts shared between the designs such as the lug 237 and the horizontal stop glaze frame member 205 previously illustrated.

Figure 20:
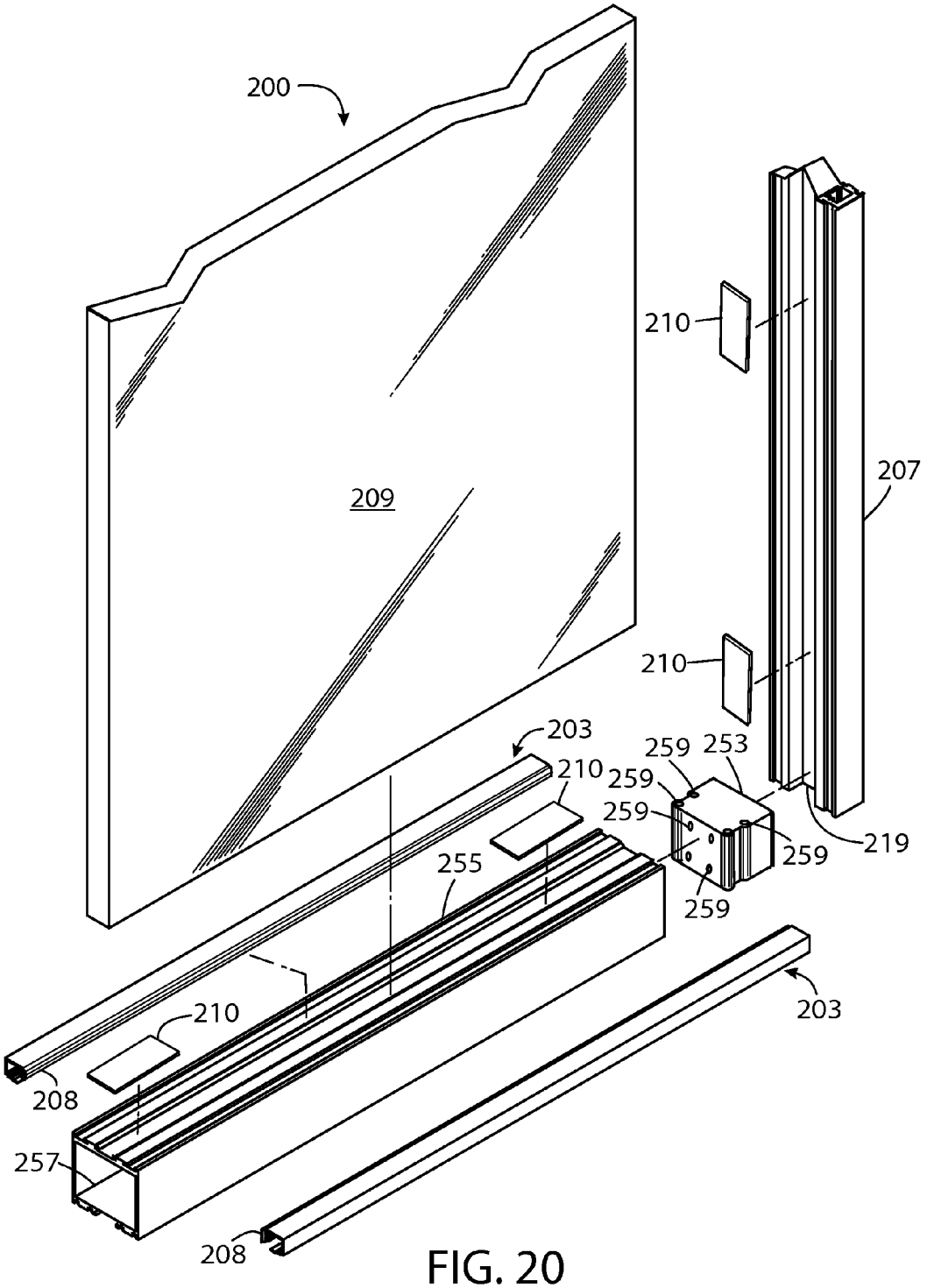
FIG. 20 illustrates, exploded view of the lower right hand portion of the glazed framed door panel of FIG. 7 utilizing an alternative lug.

FIG. 20 illustrates, exploded view of the lower right hand portion of the glazed framed door panel 200 of FIG. 7 utilizing an alternative lug 253 and showing the relationship between the glass panel 209, an alternative horizontal stop glaze frame member 255, and glazing stops 203 with glazing stop gaskets 208. In addition, FIG. 20 illustrates the relationship between the u-shaped channel 219 of the vertical marine glaze frame member 207 and the setting block 210 that is vertically oriented. The alternative lug 253 illustrated is made out of a solid block of rigid material such as aluminum.

Figure 21:
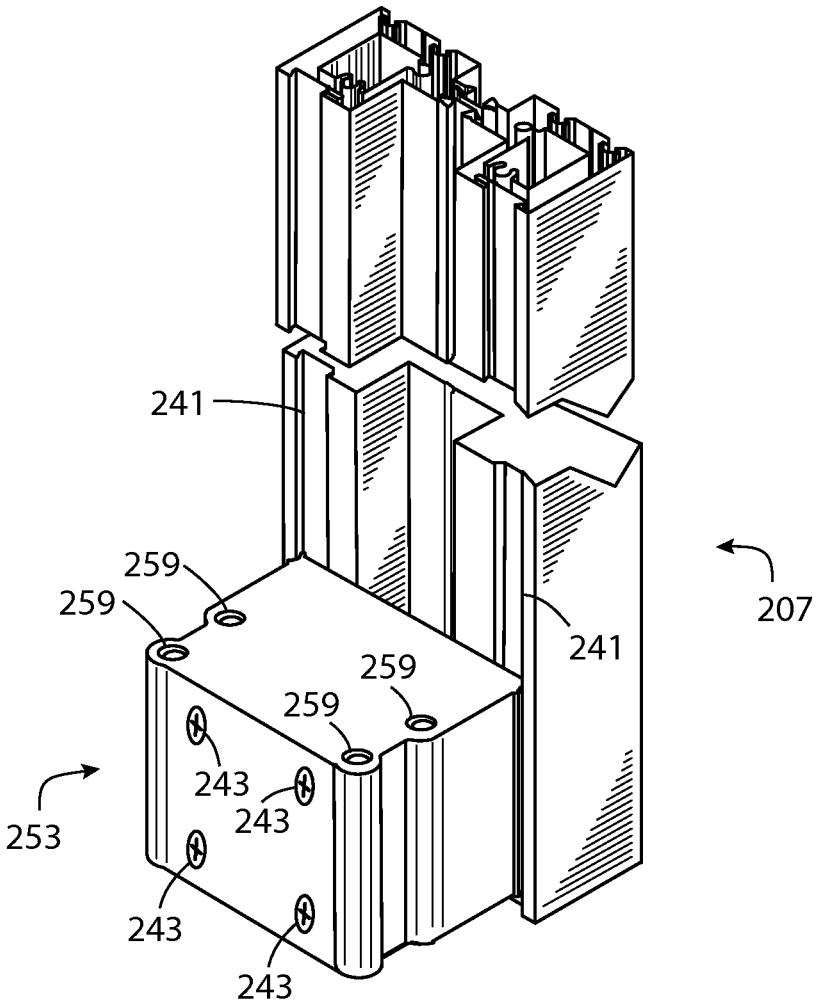
FIG. 21 illustrates, a detail view of the vertical marine glaze frame member of FIG. 20 showing the alternative lug attached.
Figure 22:
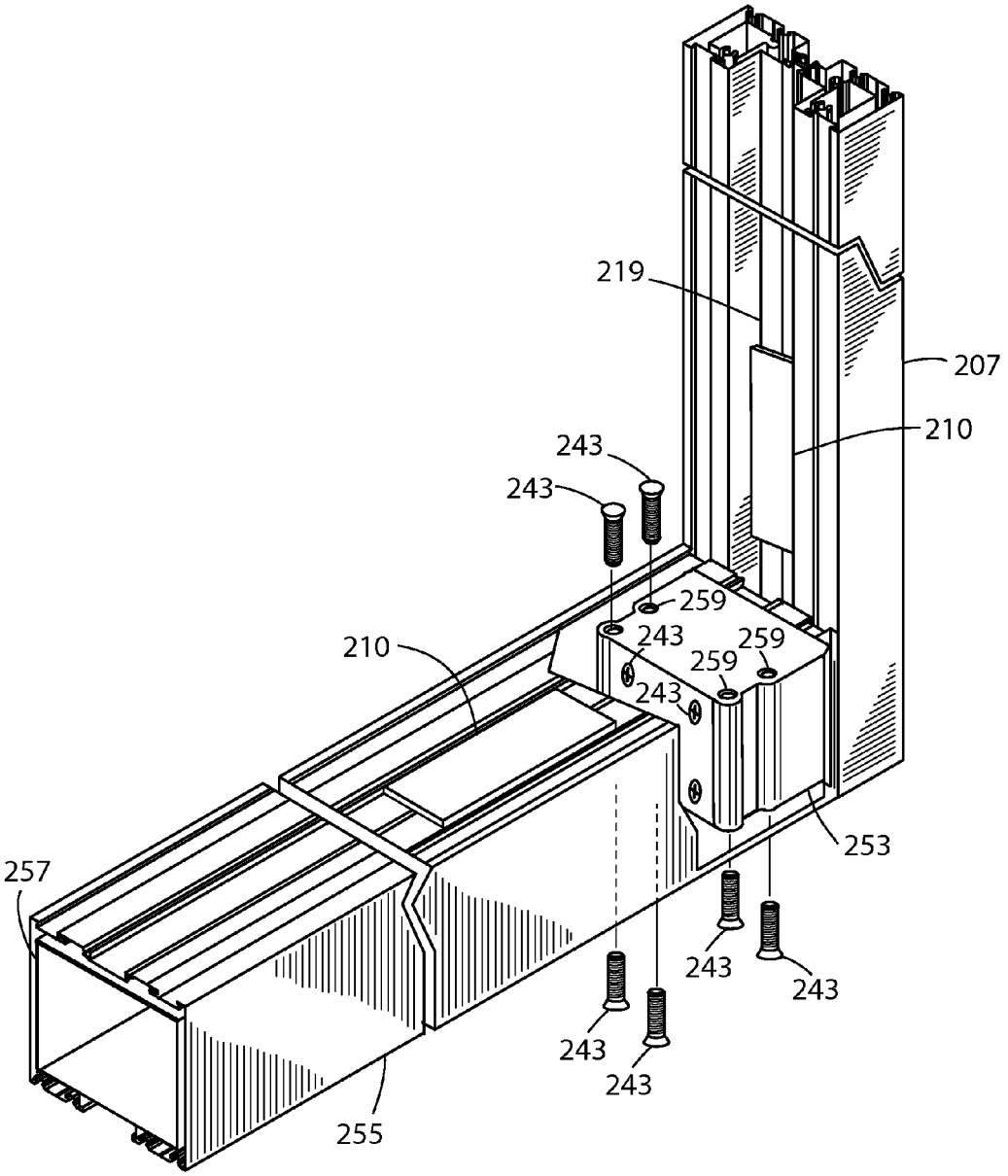
FIG. 22 illustrates, the right vertical frame member and lower horizontal frame member of FIG. 20. The horizontal frame member is shown in partial cutaway to reveal the relationship between the alternative lug and frame members.

FIG. 21 illustrates, a detail view of the vertical marine glaze frame member 207 of FIG. 20 showing the alternative lug 253 attached. FIG. 22 illustrates the vertical marine glaze frame member 207 and an alternative horizontal stop glaze frame member 255 of FIG. 20. In FIG. 20, the alternative horizontal stop glaze frame member 255 is shown in partial cutaway to reveal the relationship between the alternative lug 253 and frame members. Referring to FIGS. 20-22, the alternative lug 253 that engaged the inward facing outer surface of the vertical marine glaze frame member 207 and at the same engages a hollow interior portion 257 of secured to the alternative horizontal stop glaze frame member 255 through a hollow interior portion 257. The alternative lug 253 includes apertures 259 on both the horizontal and vertical surfaces of the alternative lug 253. In FIGS. 21-22, the alternative lug 253 is secured to the surface of the vertical marine glaze frame member 207 by the threaded fasteners 243 passing into the vertical surface of the alternative lug 253 through the apertures 259 of FIG. 20.

Referring to FIG. 22, the alternative lug 253 portion extending from the vertical marine glaze frame member 207 and alternative lug 253 assembly is slid into the hollow interior portion 257 of the alternative horizontal stop glaze frame member 255. Also illustrated is setting block 210 that is vertically oriented and seated on the bottom of the u-shaped channel 219 of the vertical marine glaze frame member 207. The setting block 210 that is horizontally oriented is illustrated resting on the horizontal stop glaze frame member 205 with a portion either even with or projecting above the top surface of the alternative horizontal stop glaze frame member 255. The threaded fasteners 243, shown exploded both above and below, extend into corresponding horizontal surfaces of the alternative horizontal stop glaze frame member 255 and into apertures 259 in corresponding horizontal surfaces of the alternative lug 253 thereby securing the vertical marine glaze frame member 207 and alternative lug 253 assembly to the alternative horizontal stop glaze frame member 255.

In FIG. 21, the alternative lug 253 does not slidably engage the slots 241 as described for the lug 237 of FIG. 12. Instead, the alternative lug 253 rests on the surface of the vertical marine glaze frame member 207 and is secured directly by the threaded fasteners 243 as previously described.

Figure 23:
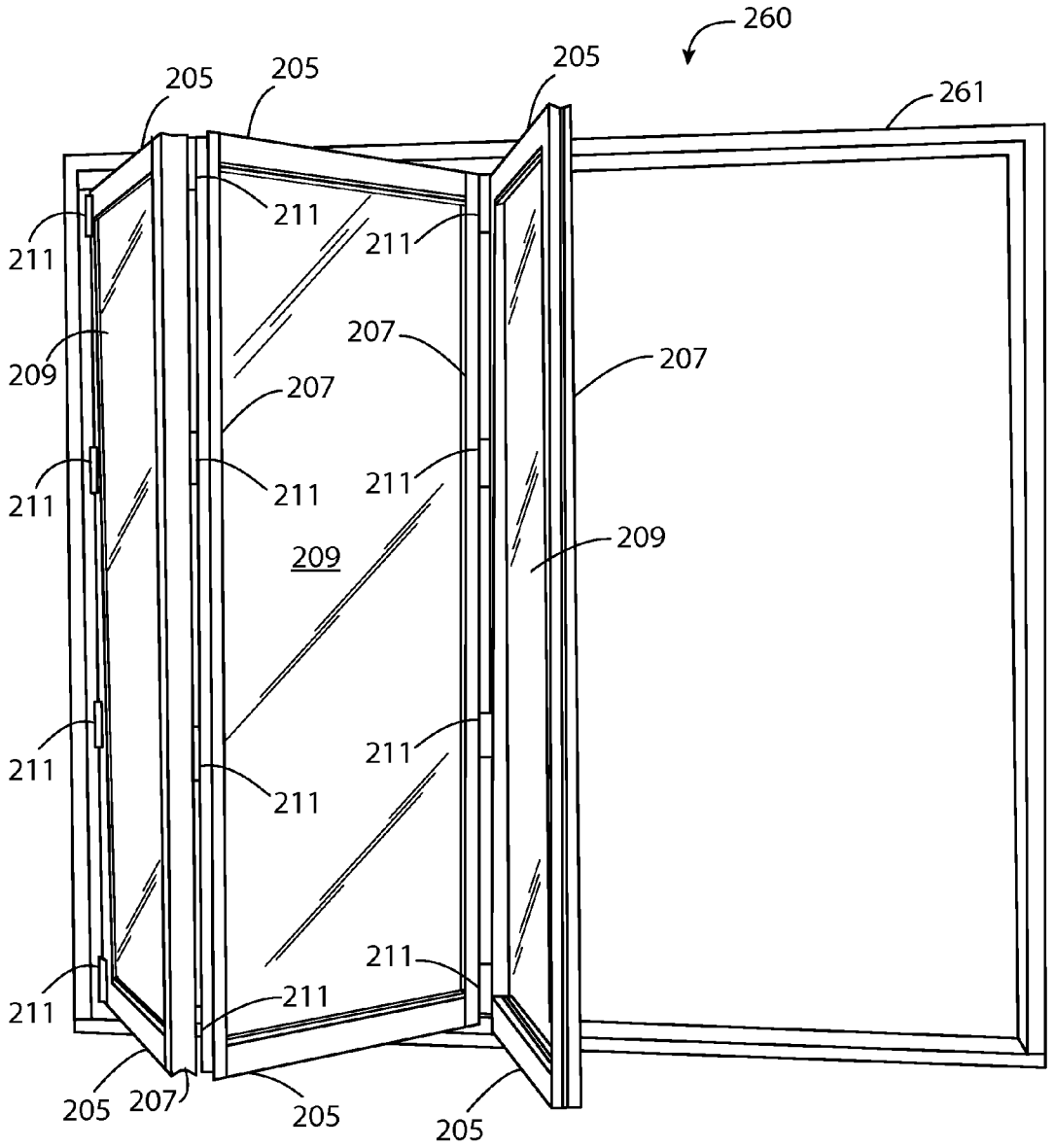
FIG. 23 illustrates the glazed frame door panel of the present disclosure utilized in a folding door structure.

FIG. 23 illustrates the glazed frame door panel of the present disclosure utilized in a folding door structure 260. Illustrated is a doorframe 261, the horizontal stop glaze frame members 205, the vertical marine glaze frame members 207, the glass panels 209, and hinges 211.

Figure 24:
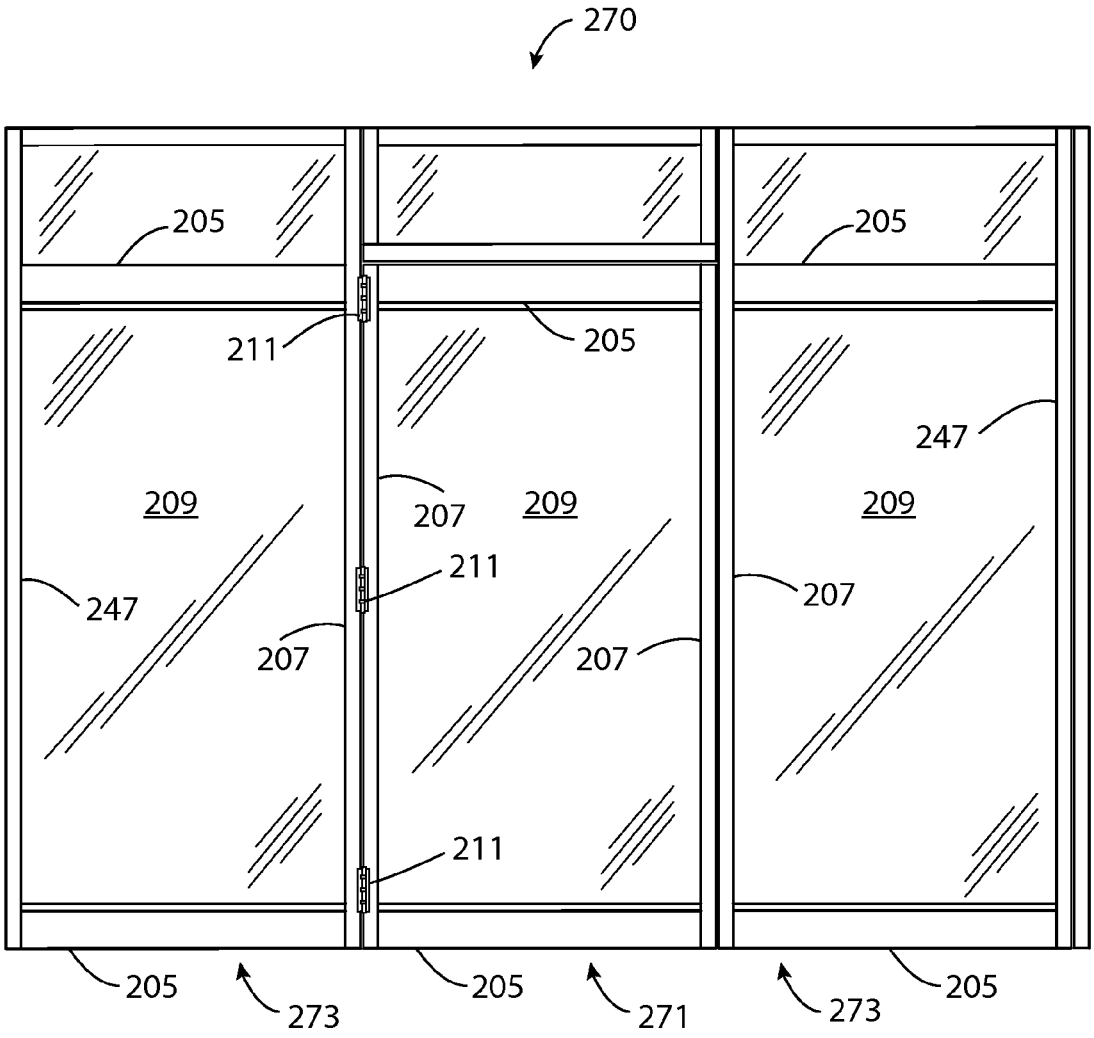
FIG. 24 illustrates the glazed frame door panel structure of the present disclosure utilized in a swing door, and fixed framed glass panels, also known as fixed lites.

FIG. 24 illustrates the glazed frame door panel structure 270 of the present disclosure utilized in a swing door 271, and fixed framed glass panels 273, also known as fixed lites. The swing door 271 includes horizontal stop glaze frame members 205, vertical marine glaze frame members 207, glass panels 209, and hinges 211. The door facing portions of the fixed framed glass panels 273 include horizontal stop glaze frame members 205, vertical marine glaze frame members 207, and glass panels 209. The vertical sides opposing the swing door 271 include alternative vertical marine glaze frame members 247.

Figure 25:
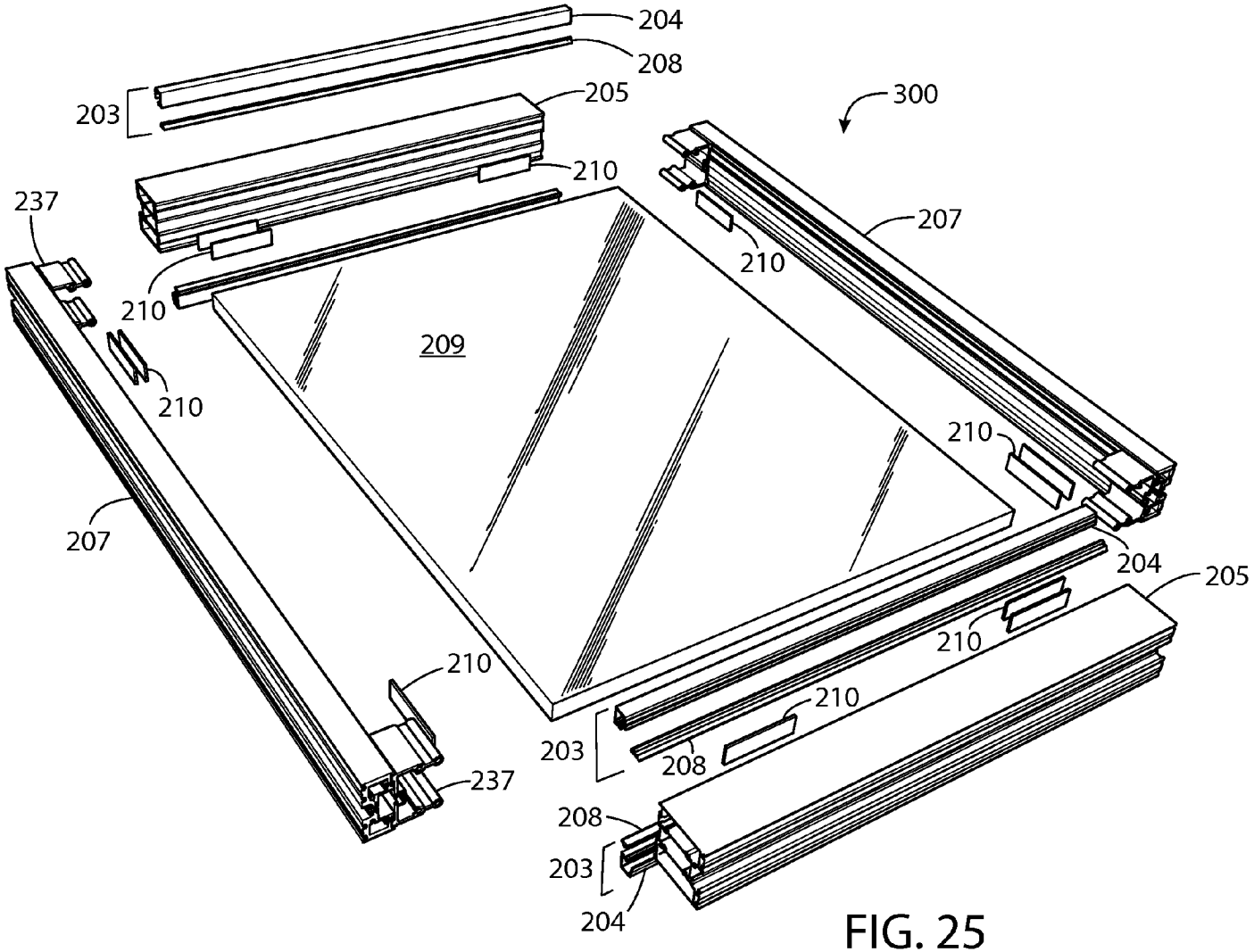
FIG. 25 illustrates an exploded view of a of a glazed framed door panel of the present disclosure, including horizontal stop glaze frame members, and vertical marine glaze frame members.

FIG. 25 illustrates an exploded view of an alternative embodiment of the of a glazed framed door panel 300 of the present disclosure, including the horizontal stop glaze frame members 205, and the vertical marine glaze frame members 207. The exploded view is shown as if the glazed framed door panel 300 were lying horizontally. This embodiment is equivalent to the embodiment of FIG. 7 only differing from the original in the length of the vertical marine glaze frame members 207 and glass panel 209. This has been shortened for the purpose of illustration. The reader should understand that the discussion for FIGS. 25-43 can also apply to FIGS. 7-24. Illustrated are each vertical marine glaze frame member 207 with lugs 237 attached to and projecting perpendicularly inward from each end of the vertical marine glaze frame member 207. The glass panel 209 is shown in relationship to vertical marine glaze frame members 207, the horizontal stop glaze frame members 205, the glazing stops 203, and the setting blocks 210. The glazing stops 203 are exploded to show the glazing stop frames 204 and the glazing stop gaskets 208.

Figure 26:
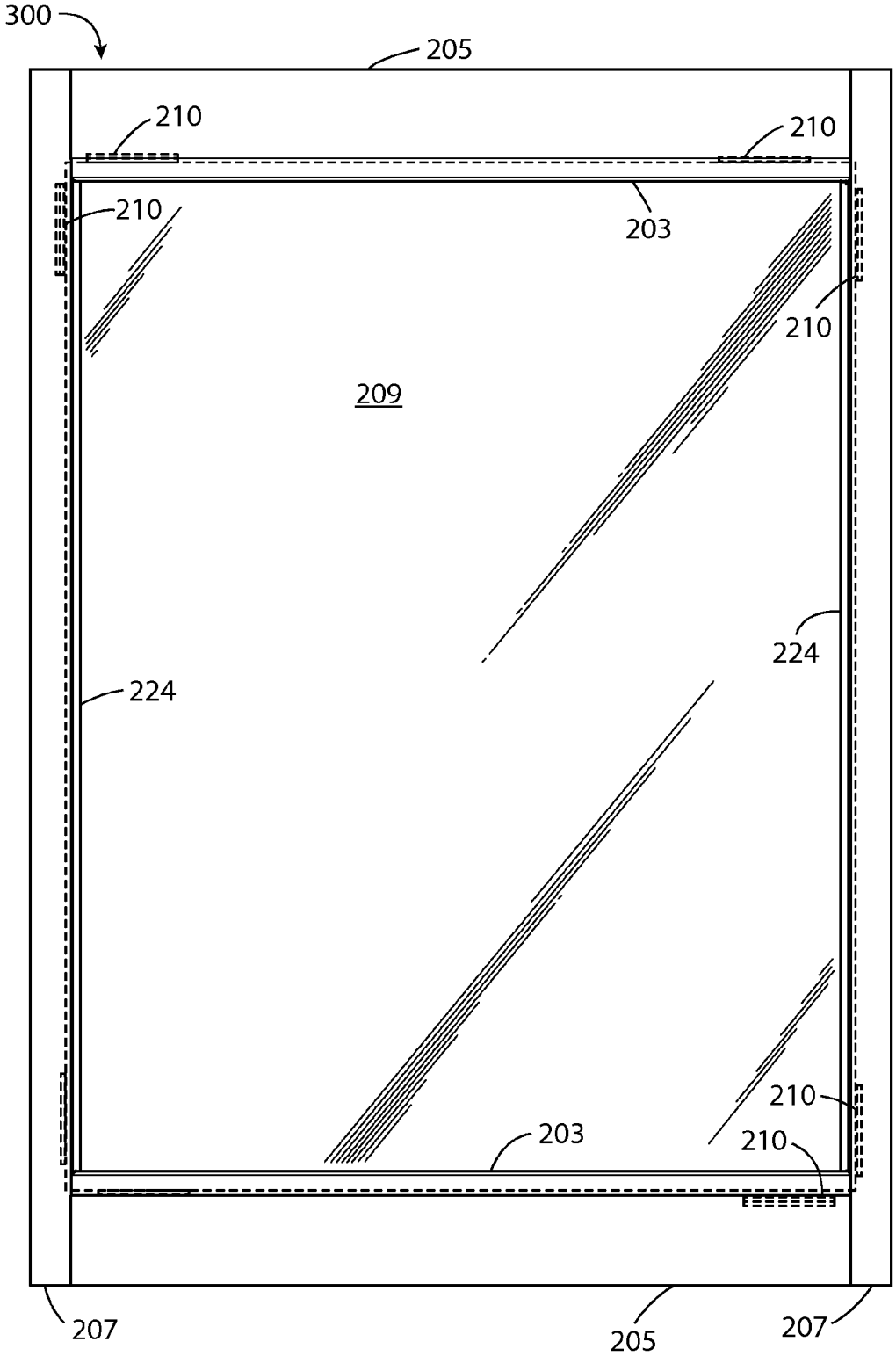
FIG. 26 illustrates a front view of the glazed framed door panel of FIG. 25 showing glass panel edges and setting blocks in hidden view represented by broken lines.

FIG. 26 illustrates a front view of the glazed framed door panel 300 of FIG. 25 showing the edges of the glass panel 209 and setting blocks 210, which are hidden within the horizontal stop glaze frame members 205 vertical marine glaze frame members 207 and represented by broken lines. The bottom edge of the glass panel 209 is seated against the horizontal stop glaze frame member 205 in the bottom of the FIG. 26 by setting blocks 210. The setting blocks 210 hold the bottom edge of the glass panel 209 slightly above the top surface of the horizontal stop glaze frame member 205 to prevent the glass from breaking. The glass panel 209 is held in place by the glazing stops 203 on both the front and rear surfaces of the glass panel 209. Similarly the top edge of the glass panel 209 is seated against the horizontal stop glaze frame member 205 in the top of the FIG. 26 by setting blocks 210. The setting blocks 210 hold the top edge of the glass panel 209 slightly below the top surface of the horizontal stop glaze frame member 205 to prevent the glass from breaking. The glass panel 209 is held in place by the glazing stops 203 on both the front and rear surfaces of the glass panel 209.

The left and right edges of the glass panel 209 are each seated against the bottom of the u-shaped channels 219 of the vertical marine glaze frame members 207 by setting blocks 210. The glazing stops 203 on the horizontal stop glaze frame members 205 align the glass panel 209 within the u-shaped channels 219 of the vertical marine glaze frame members 207. The void between the glass panel 209 and frame edges of the vertical marine glaze frame member 207 is filled and secured by structural glazing sealant 224.

Over time, because of gravity, glazed framed door panel rotates and sags toward the lower bottom corner opposite the hinge. This causes the door become out of square with the doorframe. The glass panel 209 is the generally the heaviest component and is responsible for most of the sag. One way to counteract sagging is to cross-block. That is, to add setting blocks 210 along two diagonal corners. In FIG. 26, an additional number of setting blocks 210 are added in the upper left hand corner and lower right hand corner to push the weight of the glass panel 209 toward the upper hinge side of the door. The additional number of setting blocks 210 are added by first removing the glazing stops 203 on one face of the door only and using a tool such as a glazing wedge to insert the additional number of setting blocks 210.

One advantage of the glazed frame door panel of FIG. 6 and the glazed framed door panel 300 of FIG. 26 over a conventional marine glaze framing system is that that the glass panel 209 can be cross-blocked and "toe and heeled" without disassembling the frame.

Figure 27:
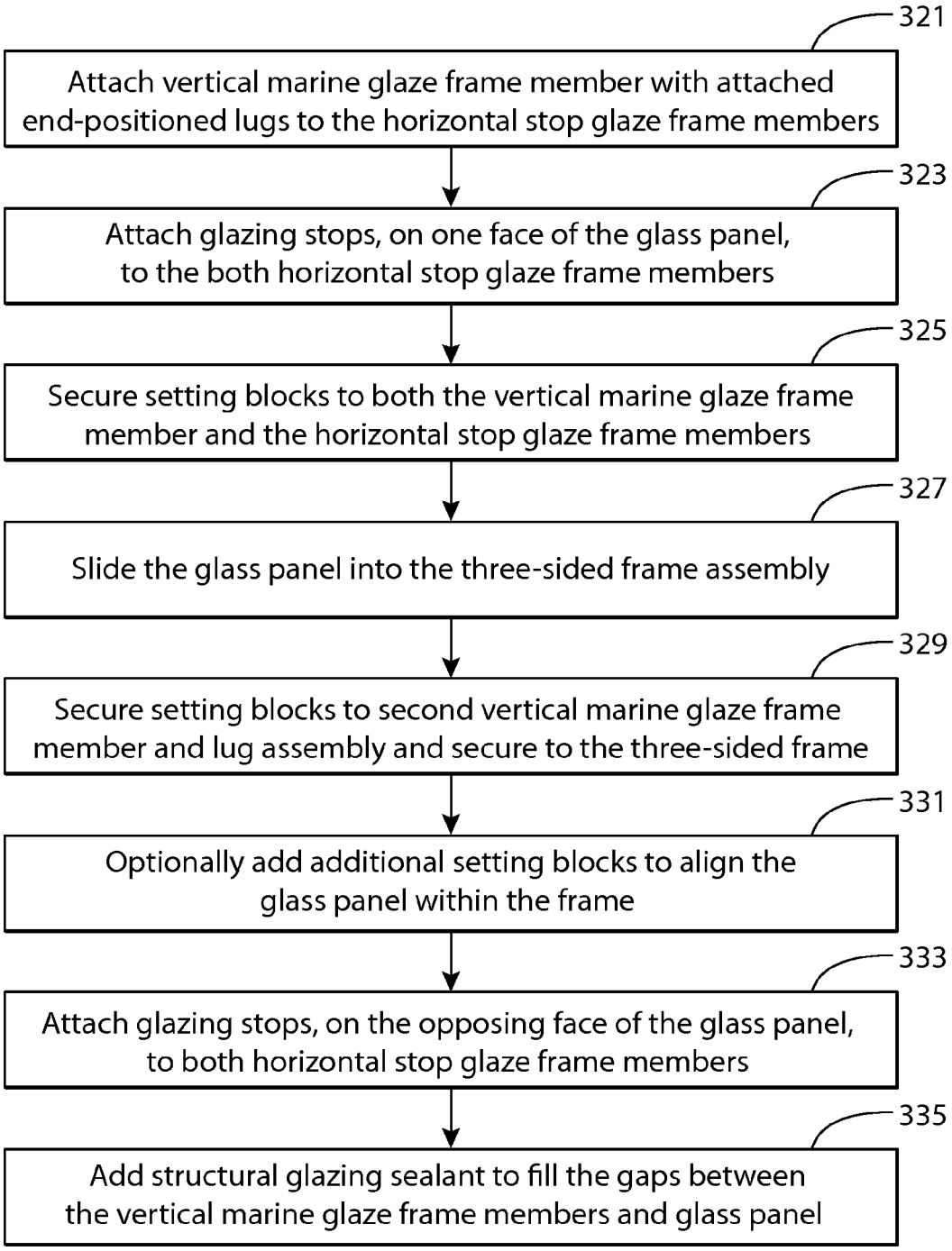
FIG. 27 illustrates a flow chart representing a process for assembling the glazed frame door panel of FIG. 25.

FIG. 27 illustrates a flow chart representing a process for assembling the glazed frame door panel of FIG. 25. FIGS. 28-35 illustrate assembly steps represented in the flow chart of FIG. 27. In FIGS. 28-35, the glazed framed door panel 300 is shown being assembled in a horizontal position, which would be typical for standard sized and large sized glass doors. The assembly method can also be accomplished with the door panel in a vertical or upright position for smaller door or window panels. In that case, the three-sided assembly of FIGS. 29-32 would be supported by vertical marine glaze frame member 207, with the horizontal stop glaze frame members 205 assuming a vertical upright position. It should be noted that the order of assembly of certain elements such is not critical and can be interchanged. For example, the glazing stops 203 in FIG. 29 and in step 323 in FIG. 27 as well as the setting blocks 210 of FIG. 30 and step 325 can be applied any time and any order before step 327. Similarly, the setting blocks 210 in FIG. 32 and in step 329 can be pre-applied to the second of the vertical marine glaze frame members 207 at any time up to step 329.

Figure 28:
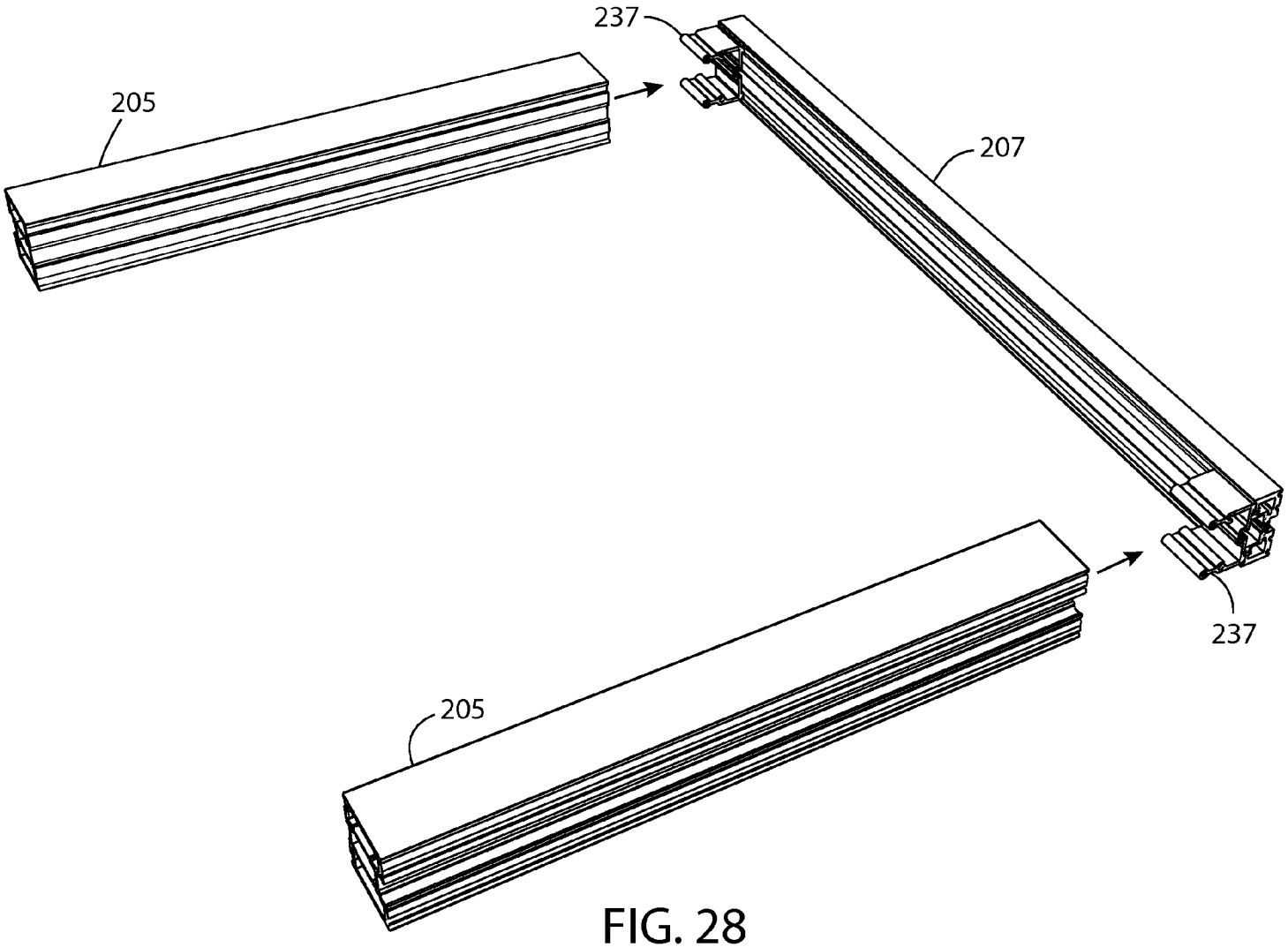
FIG. 28 illustrates a step in assembling the glazed framed door panel of FIG. 25 where two horizontal stop glaze frame members are attached to a vertical marine glaze frame members.

FIG. 28 illustrates step 321 in assembling the glazed framed door panel 300 of FIG. 25 where two of the horizontal stop glaze frame members 205 is attached to a vertical marine glaze frame member 207. Lugs 237 are pre-attached to each end of vertical marine glaze frame member 207 as previously described for FIG. 12. The lug 237 are inserted into the ends of the horizontal stop glaze frame members 205 so that the vertical marine glaze frame member 207 is aligned flush against the horizontal stop glaze frame members 205. The vertical marine glaze frame member 207 and lugs 237 are secured by threaded fasteners to the horizontal stop glaze frame members 205 in a manner similar to that described for FIG. 15.

Figure 29:
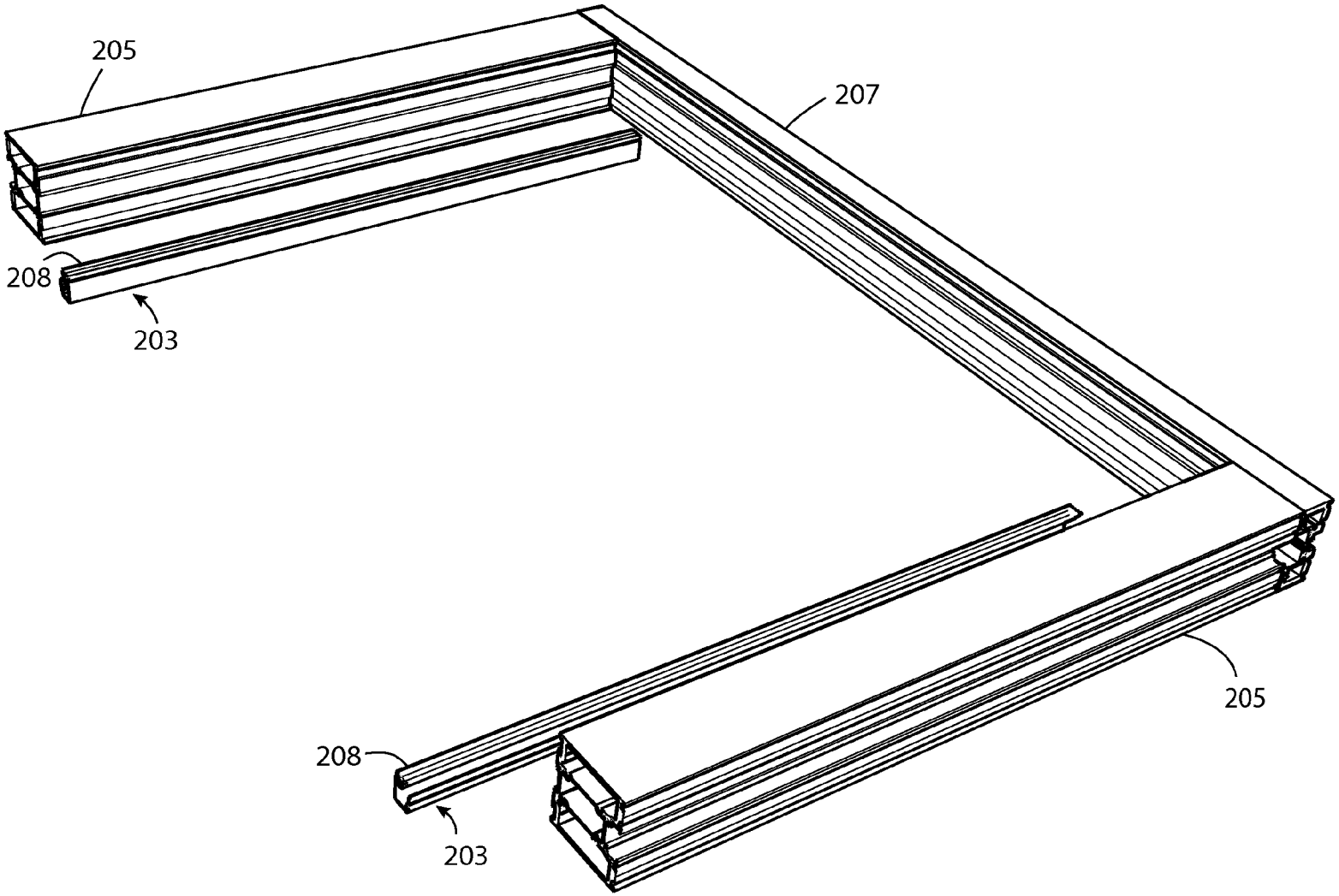
FIG. 29 illustrates a step in assembling the glazed framed door panel of FIG. 25 where the bottom side glazing stops are attached to corresponding horizontal stop glaze frame members.

Assuming that FIG. 28-35 are illustrating the assembly process in a horizontal position, as on a work surface top, FIG. 29 illustrates step 323 in assembling the glazed framed door panel 300 of FIG. 25 where the glazing stops 203 are attached to corresponding underside of the horizontal stop glaze frame members 205. The glazing stops 203 are snapped securely into the horizontal stop glaze frame member 205 to provide rigid support for the glass panel 209 as previously described. The glazing stop gaskets 208 are facing upward to provide a cushioned support surface for the glass panel 209 shown in the step illustrated in FIG. 31.

Figure 30:
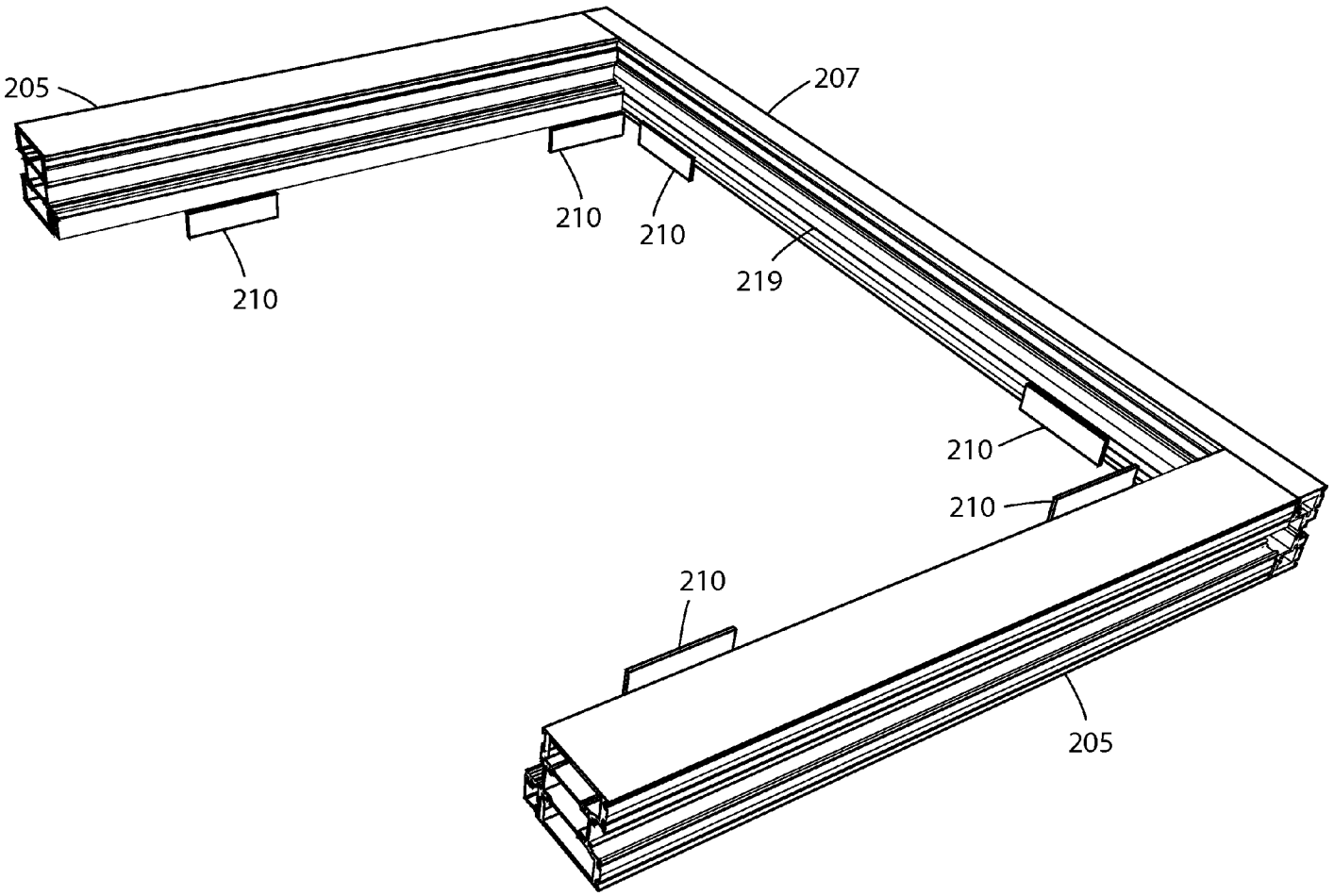
FIG. 30 illustrates a step in assembling the glazed framed door panel of FIG. 25 where setting blocks are attached to the a vertical marine glaze frame members and two horizontal stop glaze frame member.

FIG. 30 illustrates step 325 in assembling the glazed framed door panel 300 of FIG. 25 where setting blocks 210 are inserted and secured in the horizontal stop glaze frame members 205 and in the u-shaped channel 219 of the vertical marine glaze frame member 207. The setting blocks 210 can be secured to the horizontal stop glaze frame members 205 and vertical marine glaze frame members 207 in a manner known to the art; for example, adhesive, room temperature vulcanization (RTV) silicon, or self-adhesive setting blocks.

Figure 31:
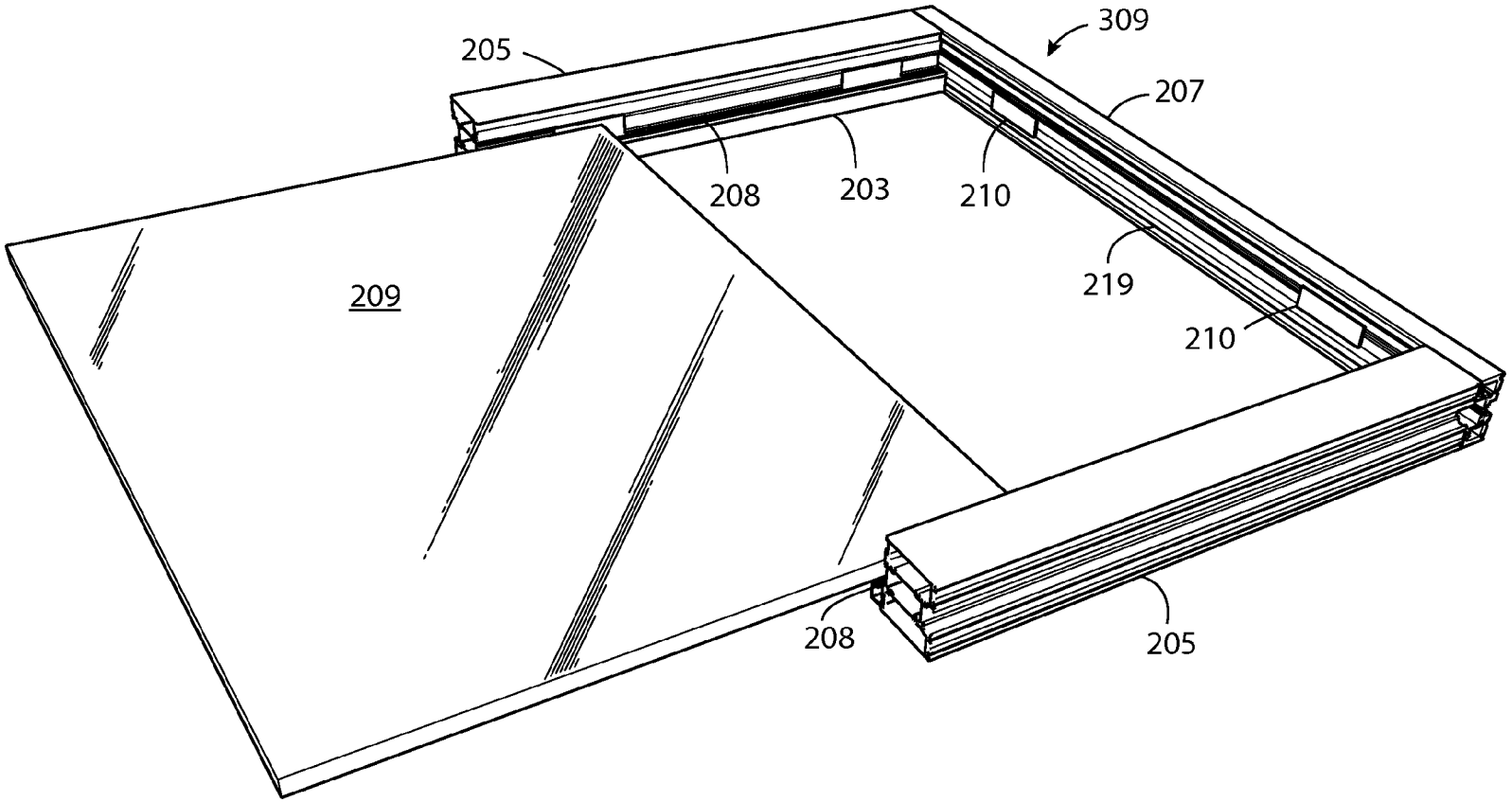
FIG. 31 illustrates a step in assembling the glazed framed door panel of FIG. 25 where the glass panel is slid into and seated in three-sided frame assembly.

FIG. 31 illustrates step 327 in assembling the glazed framed door panel 300 of FIG. 25 where the glass panel 209 is inserted and seated in three-sided frame assembly 309. The glass panel 209 can be slid along the glazing stop gaskets 208 that are attached to the glazing stops 203. Alternatively, the glass panel 209 can be placed directly downward against the glazing stop gaskets 208 and maneuvered into the u-shaped channel 219 and against the setting blocks 210 within the u-shaped channel 219 of the vertical marine glaze frame member 207. The glass panel 209 is automatically aligned with respect to the u-shaped channel 219 and the horizontal stop glaze frame member 205 by virtue of the glazing stops 203 and their respective glazing stop gaskets 208. This arrangement allows the glass panel 209 to be installed into the three-sided frame assembly 309 in a variety of ways and is a great advantage over conventional marine glaze systems.

Figure 32:
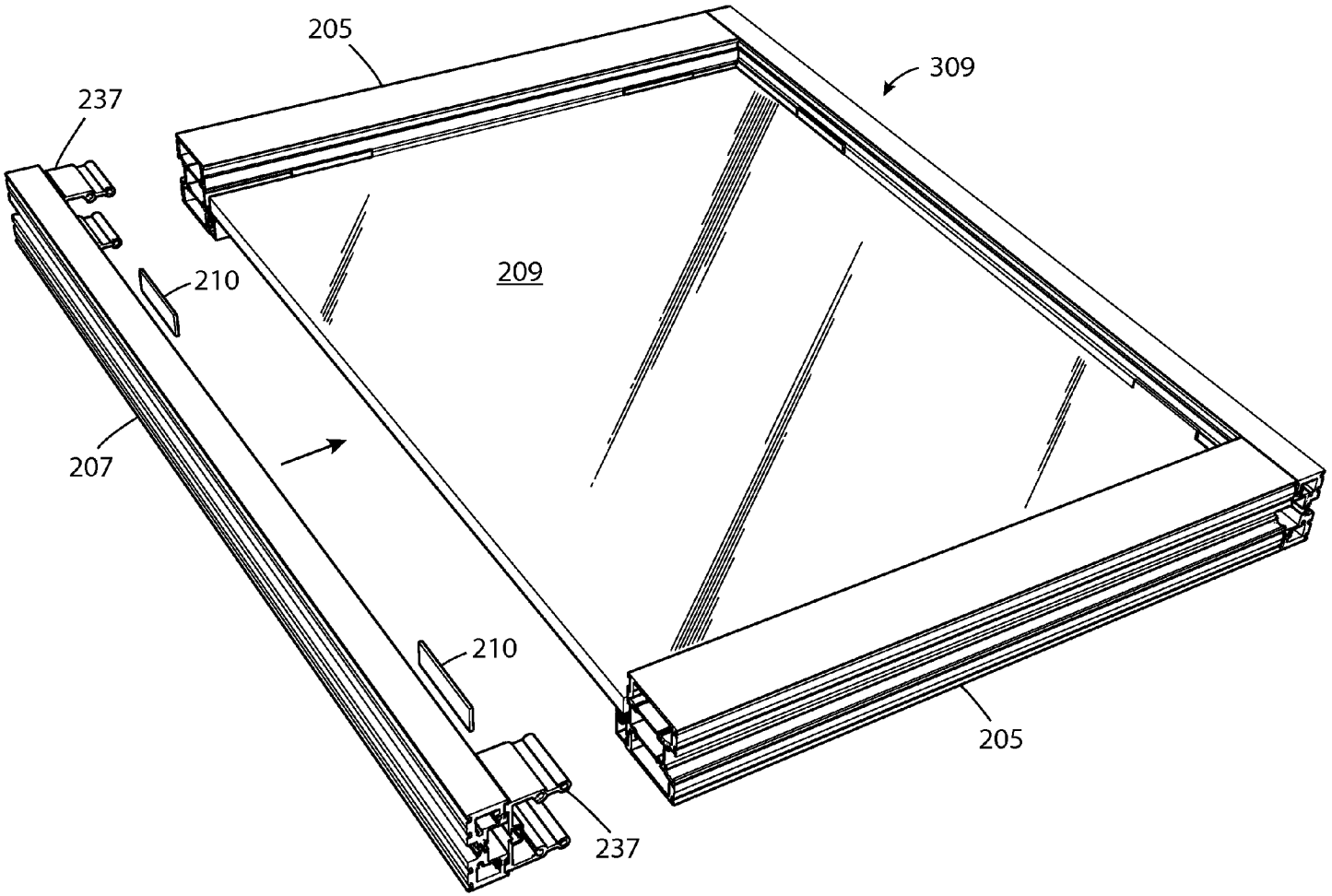
FIG. 32 illustrates a step in assembling the glazed framed door panel of FIG. 25 where setting blocks are added to the second vertical marine glass frame member and the second vertical marine glaze frame member is attached to the three-sided frame assembly.

FIG. 32 illustrates step 329 in assembling the glazed framed door panel 300 of FIG. 25 where setting blocks 210 are secured to the second of the vertical marine glaze frame members 207 and lug 237 assembly. The setting blocks 210 can be secured to the base of the u-shaped channel 219 within the vertical marine glaze frame member 207 as previously described. The vertical marine glaze frame member 207 and lug 237 assembly are attached to the three-sided frame assembly 309 as previously described for FIG. 28. The vertical marine glaze frame member 207 and lug 237 assembly self-align the glass panel 209 within the u-shaped channel 219 of previous figures by virtue of the glazing stops 203 and their corresponding glazing stop gasket 208 attached to the horizontal stop glaze frame members 205.

Figure 33:
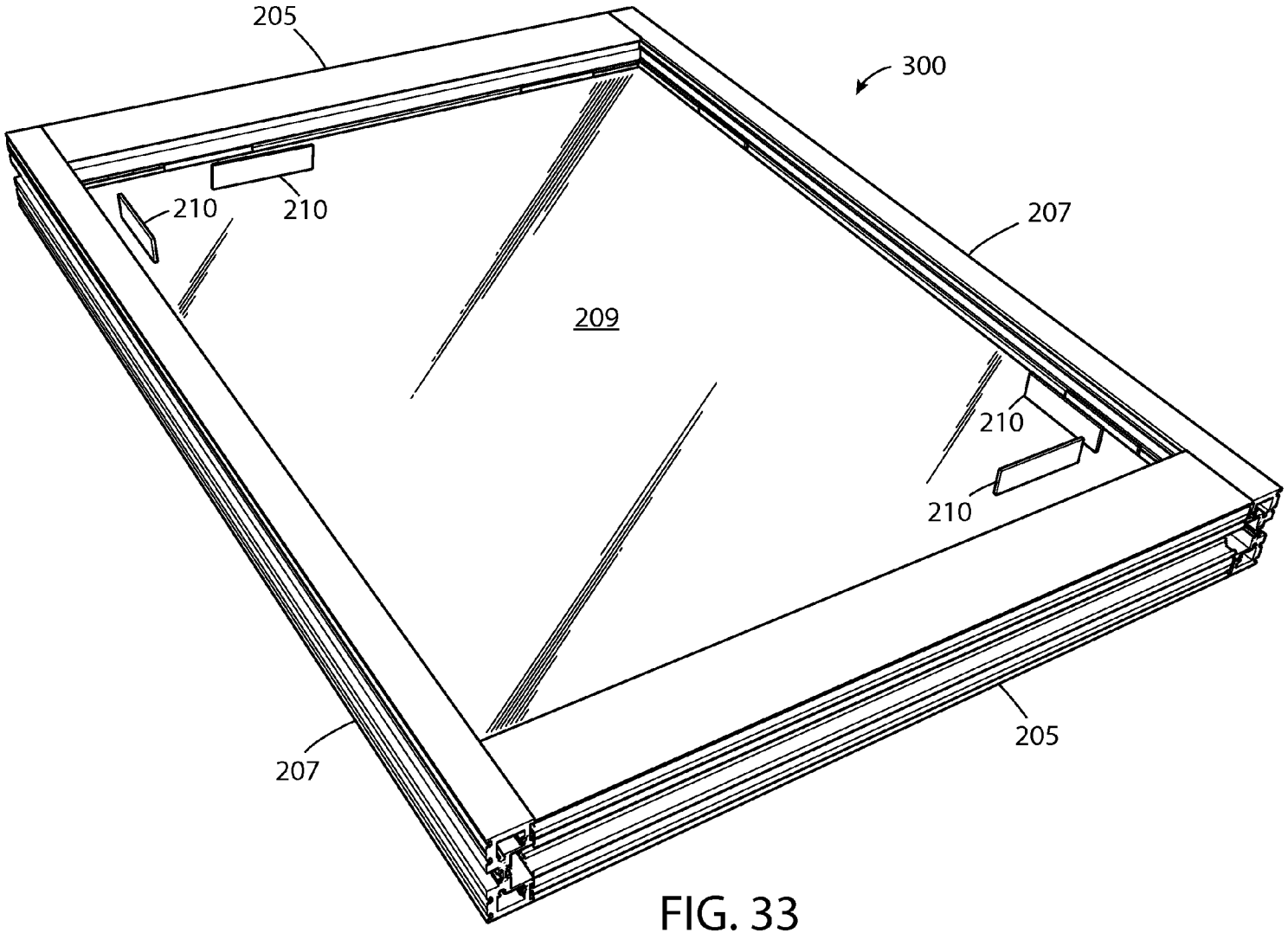
FIG. 33 illustrates a step in assembling the glazed framed door panel of FIG. 25 where the frame assembly is cross-blocked with additional setting blocks.

FIG. 33 illustrates the optional step 331 in assembling the glazed framed door panel 300 of FIG. 25 where the glazed framed door panel 300 can have setting blocks 210 added to help square the frame and help prevent sagging, as previously described. In FIG. 33 setting blocks 210 are added along the diagonal near corners of the horizontal stop glaze frame members 205 and to the vertical marine glaze frame members 207 to cross-block the glass panel 209. The setting blocks 210 can be inserted using a glazing wedge or other appropriate tool known to the art. The setting blocks 210 can be secured using RTV silicon or a suitable adhesive known in the art.

Figure 34:
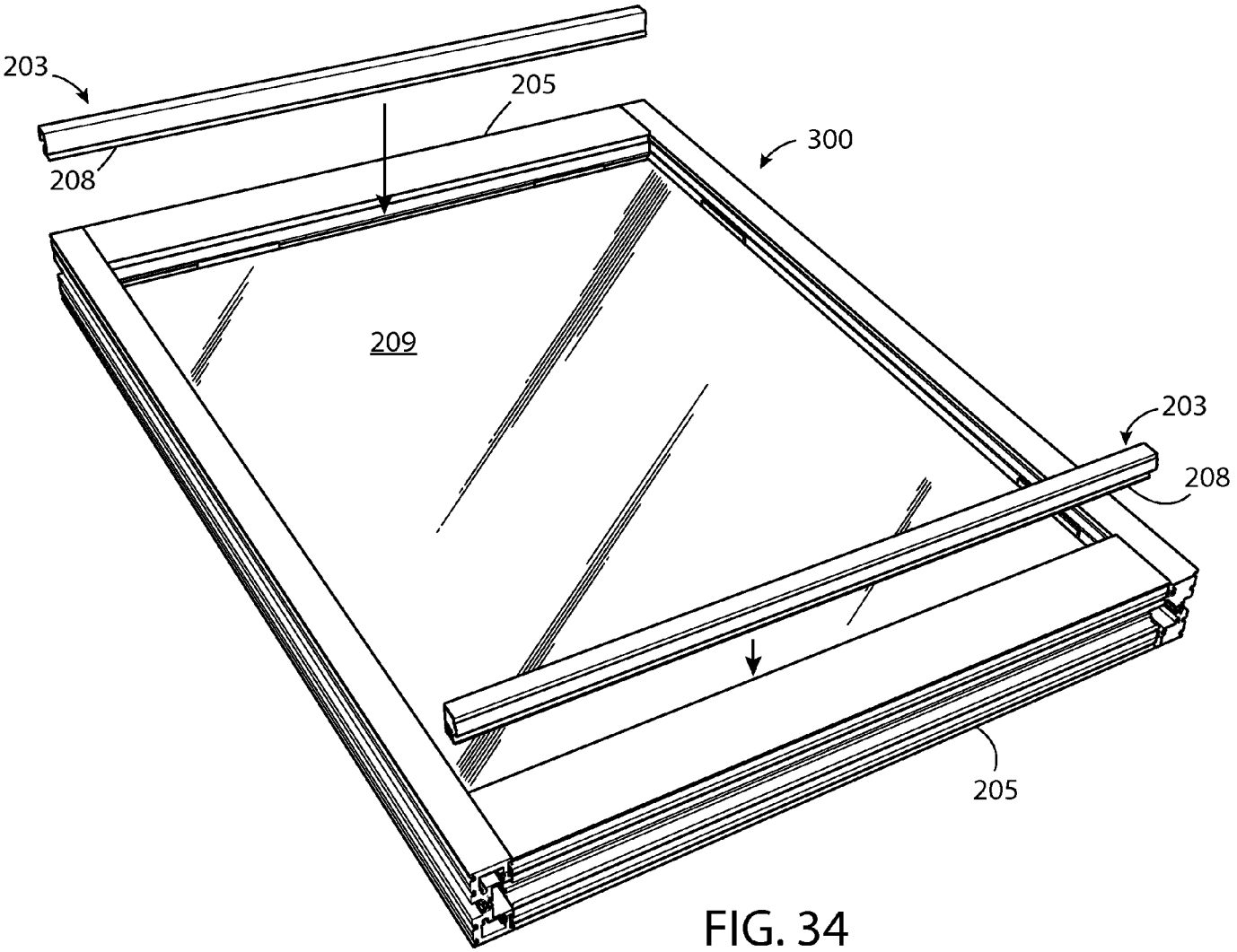
FIG. 34 illustrates a step in assembling the glazed frame door panel of FIG. 25 where glazing stops are set into the top of the frame

FIG. 34 illustrates step 333 in assembling the glazed framed door panel 300 of FIG. 25 where glazing stops 203 are secured into the top of the frame. In this embodiment, the glazing stops 203 are snapped into placed into the horizontal stop glaze frame members 205, as previously described. The glazing stop gaskets 208 directly engage the top face of the glass panel 209.

Figure 35:
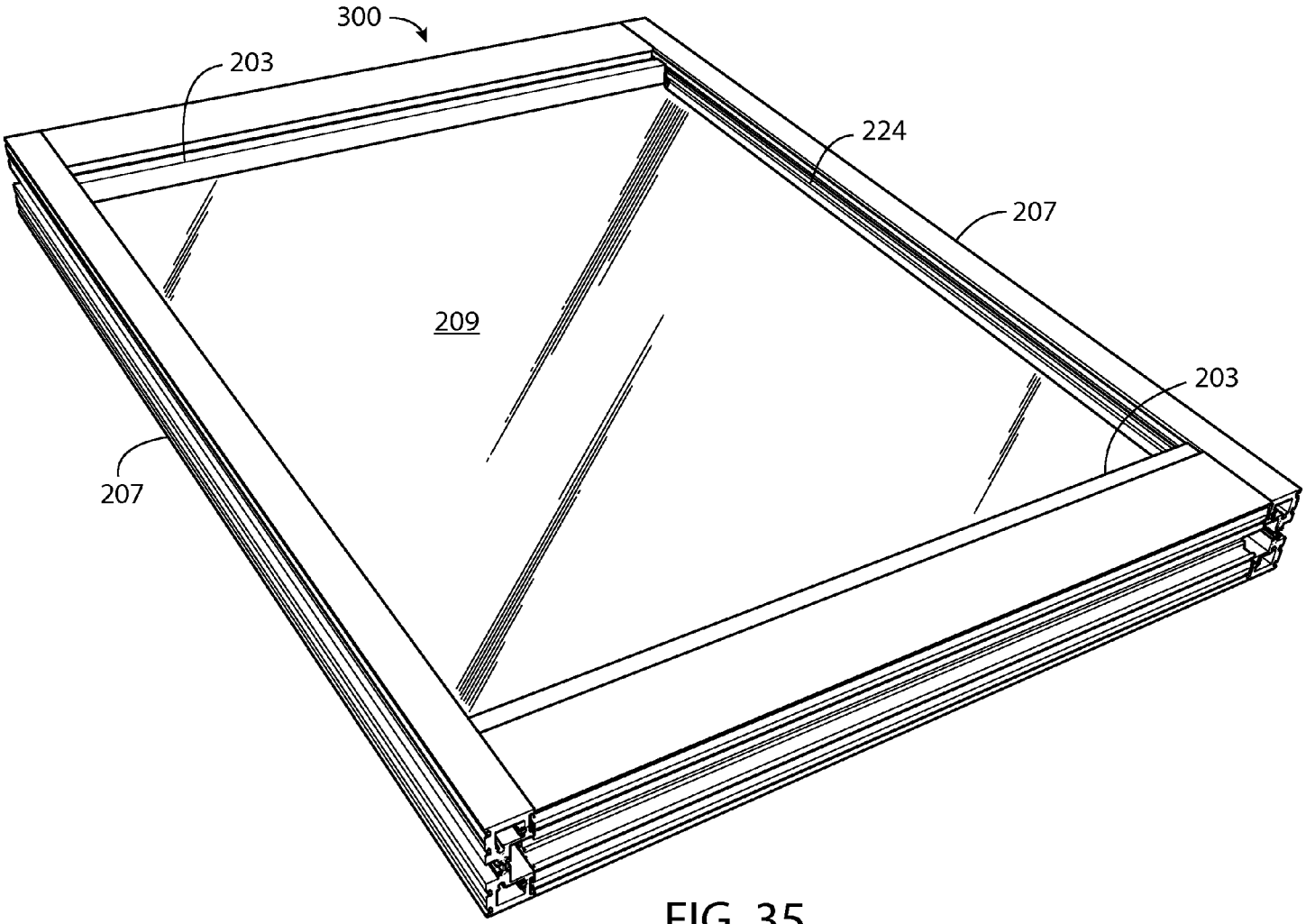
FIG. 35 illustrates a step in assembling the glazed frame door panel of FIG. 25 where structural glazing sealant along the gaps between the glass panel and the vertical marine glaze frame members.

FIG. 35 illustrates step 335 in assembling the glazed framed door panel 300 of FIG. 25 where structural glazing sealant 224 along the gaps between the glass panel 209 and the vertical marine glaze frame members 207 on both the front and the rear side of the glazed framed door panel 300. This provides both a structure and weather proof seal along the vertical marine glaze frame members 207. Structural glazing sealant 224 can optionally be applied to the contact edge between the glass panel 209 and the glazing stops 203 on the weather facing side of the glazed framed door panel 300 to further facilitate protection from the elements.

Figure 36:
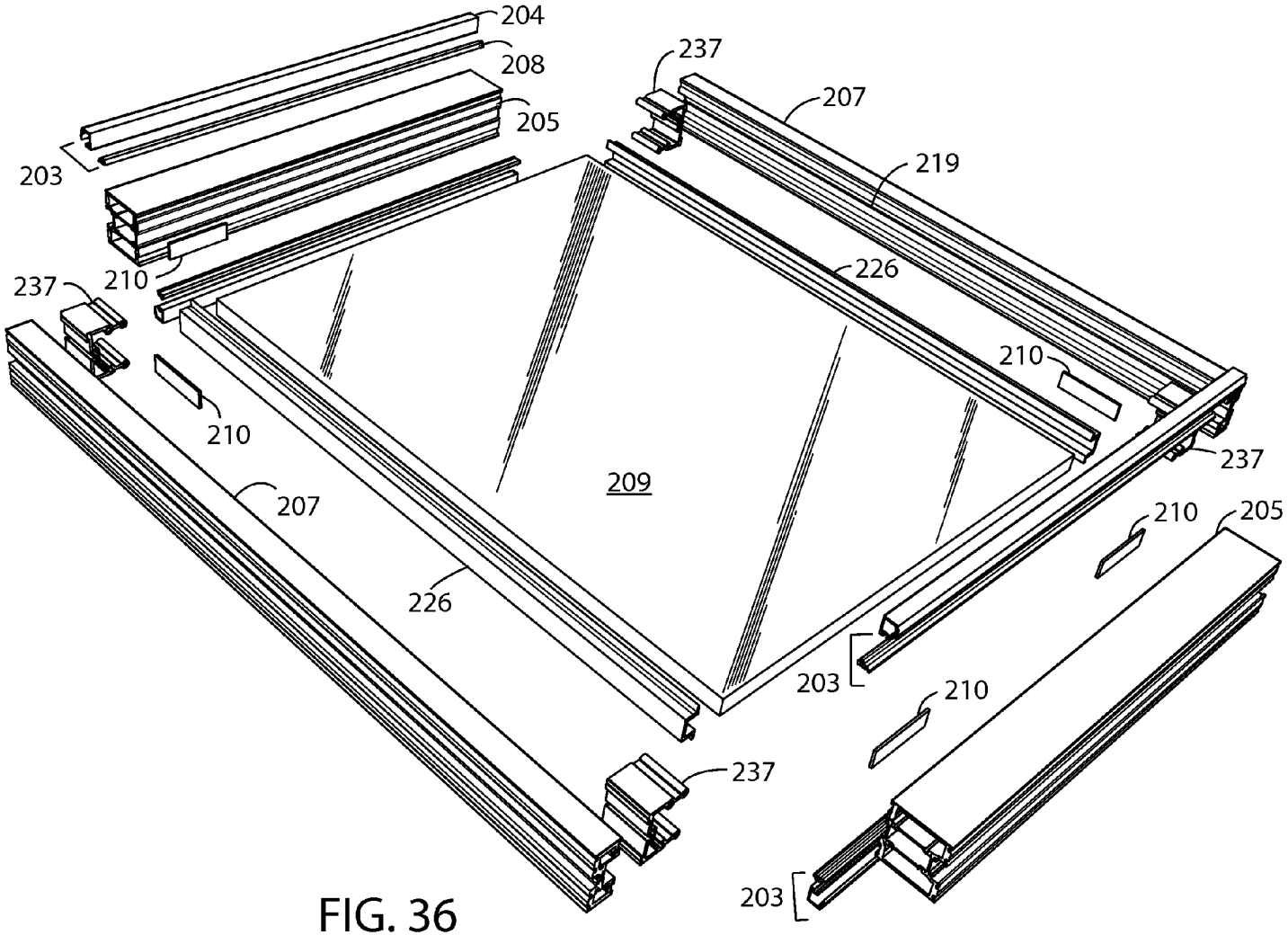
FIG. 36 illustrates an exploded view of a of a glazed frame door panel of the present disclosure using a marine glaze wrap-around gasket.

FIG. 36 illustrates an exploded view of a of a glazed framed door panel 400 of the present disclosure using a marine glaze wrap-around gasket 226 as intermediary cushioning material. The marine glaze wrap-around gasket 226 engages the left and right vertical edges of the glass panel 209 and surround a small portion of the front and rear face of the glass panel 209. The small portion is approximately equivalent or slightly smaller than the depth of the u-shaped channel 219 of the vertical marine glaze frame members 207. FIG. 36 shows the glass panel 209 in relationship to the marine glaze wrap-around gasket 226, the vertical marine glaze frame members 207, the lugs 237, the setting blocks 210, the horizontal stop glaze frame members 205, the glazing stops 203, and the components of the glazing stops 203 which include the glazing stop frames 204 and the glazing stop gaskets 206.

Figure 37:
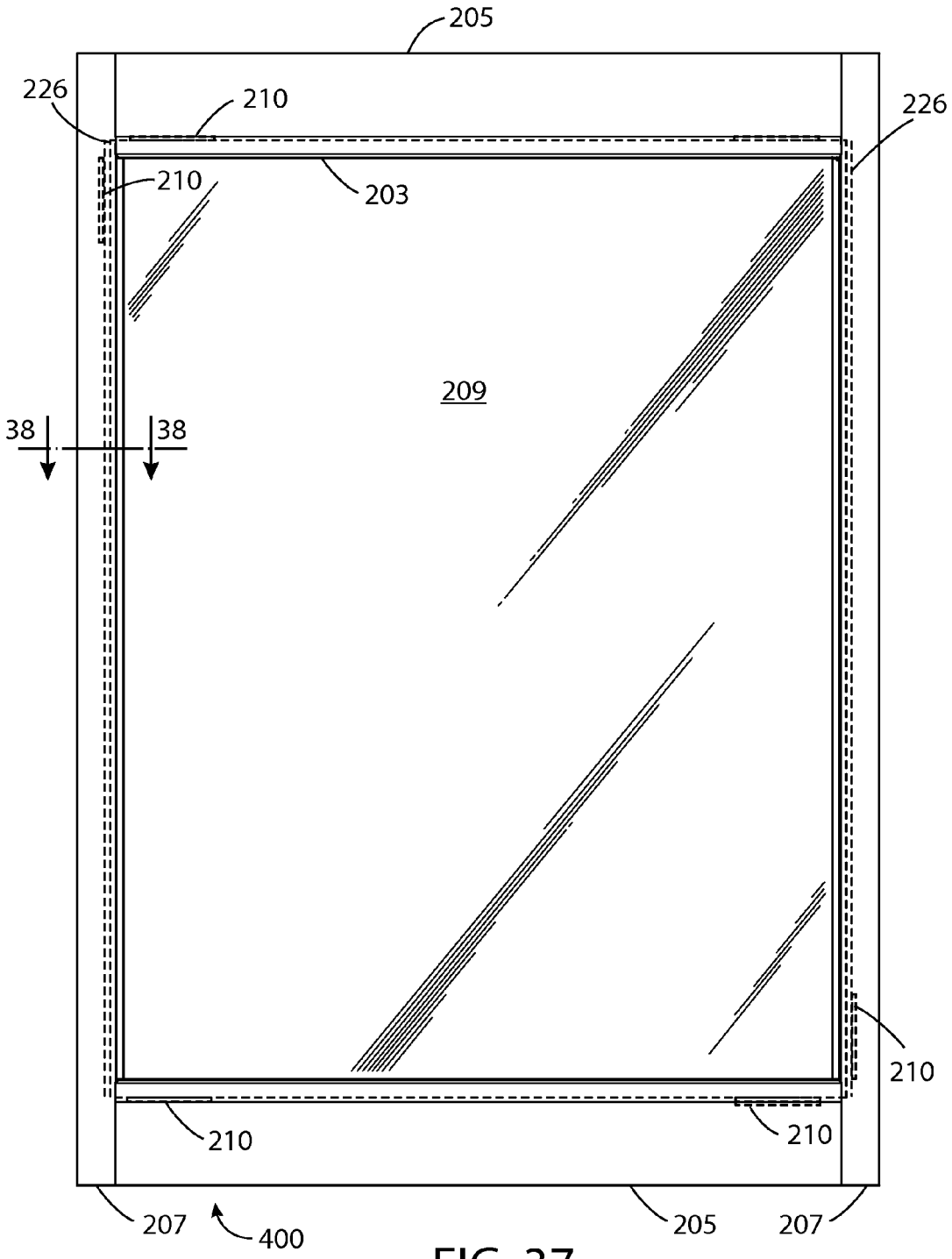
FIG. 37 illustrates a front view of the glazed frame door panel of FIG. 36 showing glass panel edges and setting blocks in hidden view represented by broken lines.

FIG. 37 illustrates a front view of the glazed framed door panel 400 of FIG. 36 showing the edges of the glass panel 209, the marine glaze wrap-around gasket 226, and setting blocks 210, which are hidden within the horizontal stop glaze frame members 205 vertical marine glaze frame members 207 and represented by broken lines. The bottom edge of the glass panel 209 is seated against the horizontal stop glaze frame member 205 in the bottom of the FIG. 37 by setting blocks 210. The setting blocks 210 hold the bottom edge of the glass panel 209 slightly above the top surface of the horizontal stop glaze frame member 205 to prevent the glass panel 209 from breaking. The glass panel 209 is held in place by the glazing stops 203 on both the front and rear surfaces of the glass panel 209. Similarly the top edge of the glass panel 209 is seated against the horizontal stop glaze frame member 205 in the top of the FIG. 37 by setting blocks 210. The setting blocks 210 hold the top edge of the glass panel 209 slightly away from the top surface of the horizontal stop glaze frame member 205 to prevent the glass panel 209 from breaking. The glass panel 209 is held in place by the glazing stops 203 on both the front and rear surfaces of the glass panel 209.

The left and right edges of the glass panel 209 are surround by the marine glaze wrap-around gaskets 226 which are seated against the bottom of the u-shaped channels 219 of the vertical marine glaze frame members 207. The glazing stops 203 on the horizontal stop glaze frame members 205 align the glass panel 209 and marine glaze wrap-around gasket 226 within the u-shaped channels 219 of the vertical marine glaze frame members 207. The void between the glass panel 209 and frame edges of the vertical marine glaze frame member 207 is filled and secured by structural glazing sealant 224.

In FIG. 37 an additional number of setting blocks 210 can be added to the upper left hand corner and lower right hand corner to push the weight of the glass panel 209 toward the upper hinge side of the door. The additional number of setting blocks 210 are added by first removing the glazing stops 203 on one face of the door only and using a tool such as a glazing wedge to insert the additional number of setting blocks 210.

Figure 38:
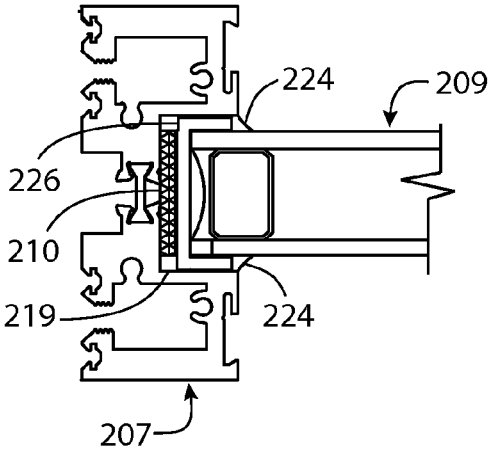
FIG. 38 illustrates a sectional view of FIG. 37 taken along section lines 38-38 showing a modified marine glaze wrap-around gasket without a trim lip.

FIG. 38 illustrates a sectional view of FIG. 37 taken along section lines 38-38 showing a marine glaze wrap-around gasket 226 modified without a trim lip. The marine glaze wrap-around gasket 226 is shown as u-shaped. The inside of the marine glaze wrap-around gasket 226 directly contacts a portion of the front and rear faces of the glass panel 209 within the interior of the u-shaped channel 219. The bottom interior portion of the marine glaze wrap-around gasket 226 directly contacts the vertical edge of the glass panel 209. The outside sides of the marine glaze wrap-around gasket 226 directly contact the u-shaped channel 219 and the outside bottom of the marine glaze wrap-around gasket 226 directly contacts the setting block 210 which in turn directly contacts the bottom of base of the u-shaped channel 219. Alternatively, if setting blocks 210 are not used, the marine glaze wrap-around gasket 226 directly engages the back of the u-shaped channel 219. The void between the top edges of the marine glaze wrap-around gasket 226, the glass panel 209, and the vertical marine glaze frame member 207 can be filled with structural glazing sealant 224.

Figure 39:
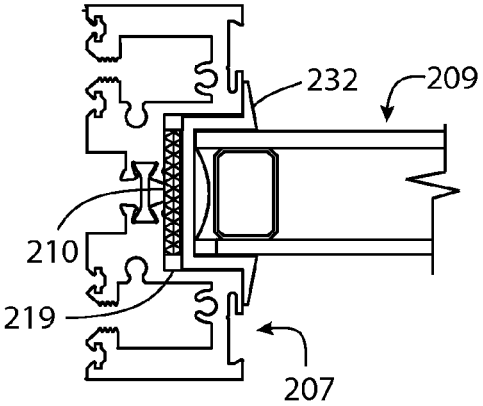
FIG. 39 illustrates an alternative section view of FIG. 37 taken along section lines 38-38 showing a marine glaze wrap-around gasket with a trim lip.

FIG. 39 illustrates an alternative section view of FIG. 37 taken along section lines 38-38 showing a marine glaze wrap-around gasket 232 with a trim lip as they are typically available. The trim lip is a flanged portion of marine glaze wrap-around gasket 232 that sits outside of the u-shaped channel 219 of the vertical marine glaze frame member 207. The trim lip helps to provide an air and moisture barrier. In FIG. 39, the trim lip seats directly against the outside surface of the vertical marine glaze frame member 207. As with FIG. 38, in FIG.

39 the inside of the marine glaze wrap-around gasket 232 directly contacts a portion of the front and rear faces of the glass panel 209 within the interior of the u-shaped channel 219. The bottom interior portion of the marine glaze wrap-around gasket 232 directly contacts the vertical edge of the glass panel 209. The outside sides of the marine glaze wrap-around gasket 232 directly contact the u-shaped channel 219 and the outside bottom of the marine glaze wrap-around gasket 232 directly contacts the setting block 210 which in turn directly contacts the bottom of base of the u-shaped channel 219. Alternatively, if setting blocks 210 are not used, the marine glaze wrap-around gasket 232 directly engages the back of the u-shaped channel 219.

Figure 40:
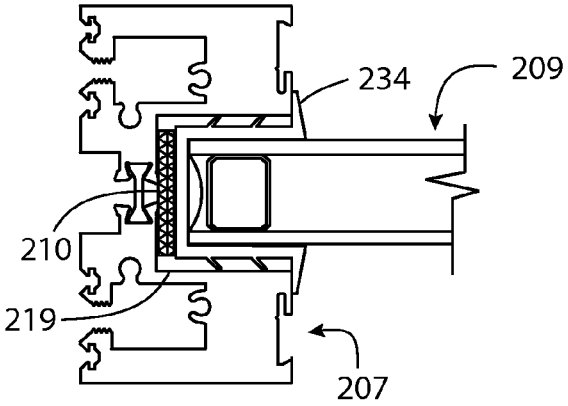
FIG. 40 illustrates a section alternative sectional view of FIG. 37 taken along section lines 38-38 showing an alternative marine glaze wrap-around gasket with a trim lip.

FIG. 40 illustrates a section alternative sectional view of FIG. 37 taken along section lines 38-38 showing a intermediary cushioning material in the form of an alternative marine glaze wrap-around gasket 234 with a trim lip and upward angled projections along the outside sides of the alternative marine glaze wrap-around gasket 234. The alternative marine glaze wrap-around gasket 234 of FIG. 40 engages the u-shaped channel 219 in a similarly to what was described for FIG. 39 except the upward angled projections engage the sides of the u-shaped channel 219.

Figure 41:
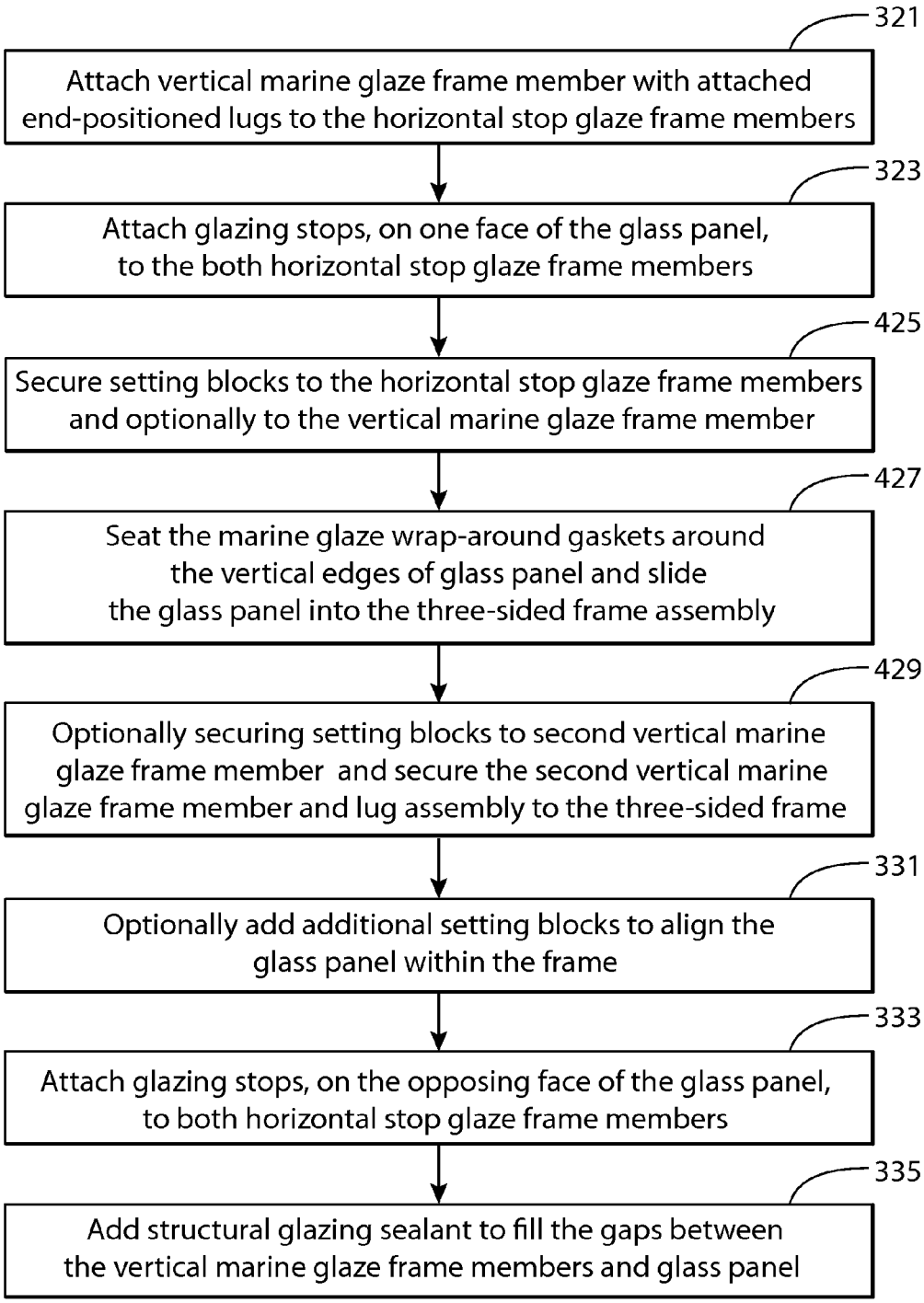
FIG. 41 illustrates a flow chart representing a process for assembling the glazed frame door panel of FIG. 37.
Figure 42:
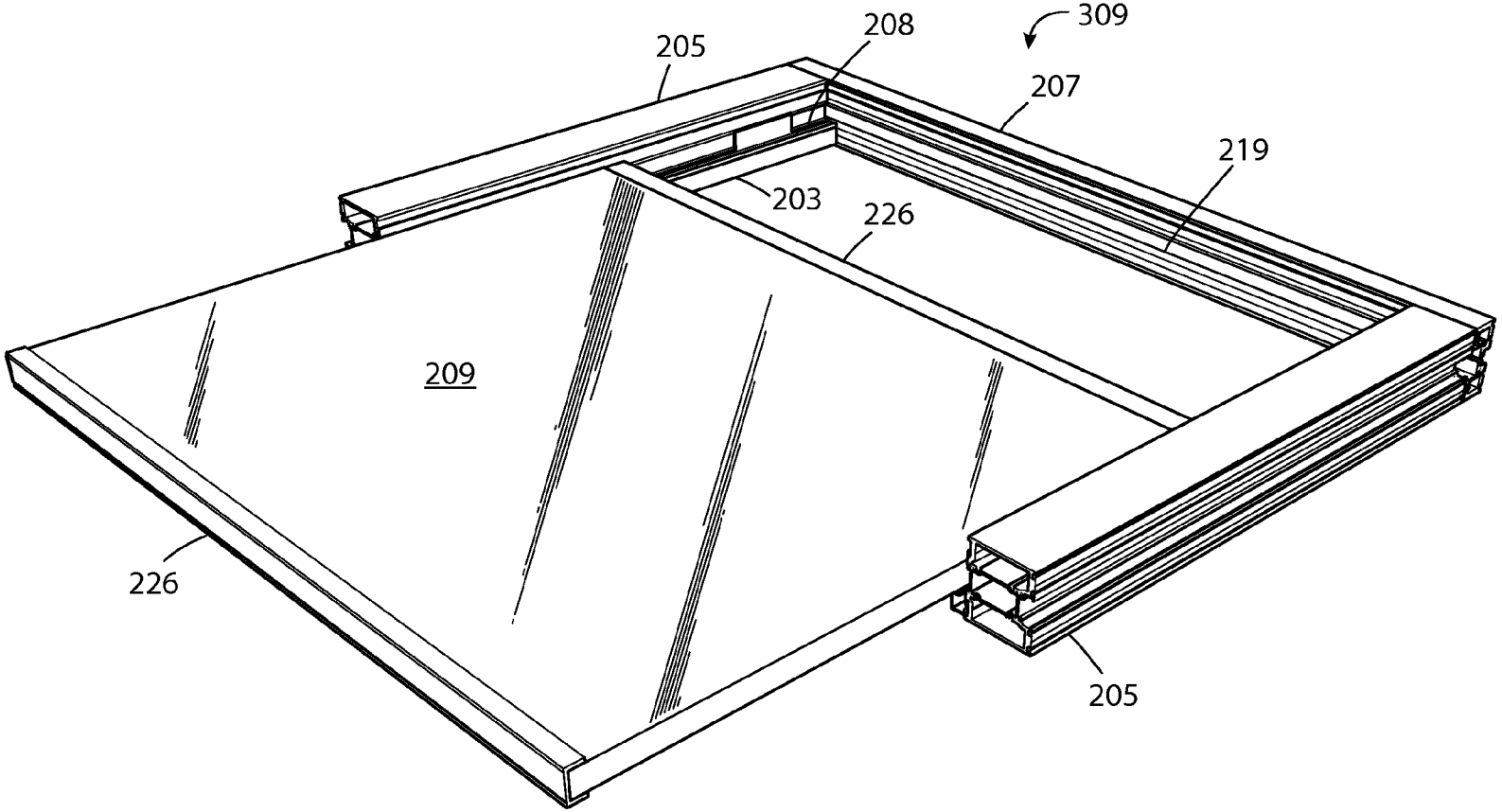
FIG. 42 illustrates a step in assembling the glazed frame door panel of FIG. 37 where the glass panel is slid into and seated in three-sided frame assembly.
Figure 43:
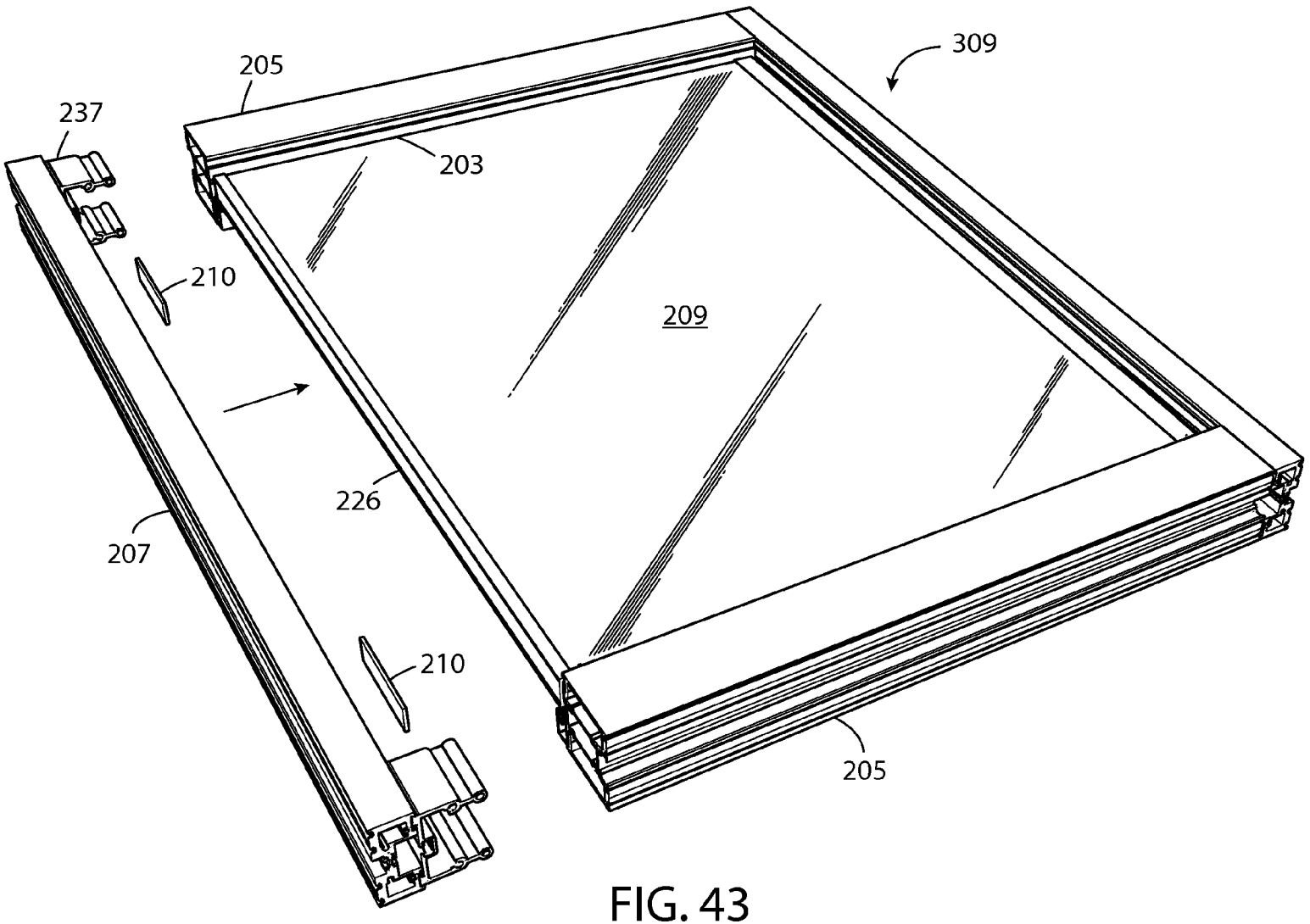
FIG. 43 illustrates a step in assembling the glazed frame door panel of FIG. 37 where setting blocks are added to the second vertical marine glass frame member and the vertical marine glaze frame member is attached to the three-sided frame assembly.

FIG. 41 illustrates a flow chart representing a process for assembling the glazed framed door panel 400 of FIG. 37. FIG. 37 illustrates the same steps represented by FIG. 27 except step 325 is replaced by step 425, step 327 is replaced by step 327 is replace by step 427 as illustrated in FIG. 42 and step 329 is replaced by step 429 as illustrated in FIG. 43. Steps 321-323 and steps 331-335 can remain essentially the same as described for FIG. 27. As previously noted that the order of assembly of certain elements is not critical and can be interchanged. For example, the glazing stops 203 in FIG. 29 and in step 323 in FIG. 27 as well as the setting blocks 210 of FIG. 30 and step 425 can be applied any time and any order before step 427. It should be noted that the applying setting blocks 210 of FIG. 30 to the vertical marine glaze frame member 207 is optional in step 425. Similarly, the setting blocks 210 in FIG. 43 and in step 429 can be pre-applied to the second of the vertical marine glaze frame members 207 at any time up to step 429.

FIG. 42 illustrates step 427 of FIG. 42 in assembling the glazed frame door panel of FIG. 37 where first the marine glaze wrap-around gasket 226 is seated around the left and right vertical edges of the glass panel 209 and then the glass panel 209 is seated in the three-sided frame assembly 309. The glass panel 209 with the marine glaze wrap-around gasket 226 in combination can be slid along the glazing stop gaskets 208 that are attached to the glazing stops 203. Alternatively, the glass panel 209 and marine glaze wrap-around gasket 226 in combination can be placed directly downward against the glazing stop gaskets 208 and maneuvered into the u-shaped channel 219 and against the setting blocks 210 within the u-shaped channel 219 of the vertical marine glaze frame member 207. The glass panel 209 is aligned with respect to the u-shaped channel 219 and the horizontal stop glaze frame member 205 by virtue of the glazing stops 203 and their respective glazing stop gaskets 208.

FIG. 43 illustrates step 429 of FIG. 41 in assembling the glazed frame door panel of FIG. 37 where setting blocks 210 are optionally secured to the second of the vertical marine glaze frame member 207 and the vertical marine glaze frame member 207 in combination with the lugs 237 is attached to the three-sided frame assembly 309. The vertical marine glaze frame member 207 and lug 237 assembly are attached to the three-sided frame assembly 309 as previously described for FIG. 28. The vertical marine glaze frame member 207 and lug 237 assembly self-align the glass panel 209 and marine glaze wrap-around gasket 226 within the u-shaped channel 219 of previous figures by virtue of the glazing stops 203 and their corresponding glazing stop gasket 208 attached to the horizontal stop glaze frame members 205.

Figure 44:
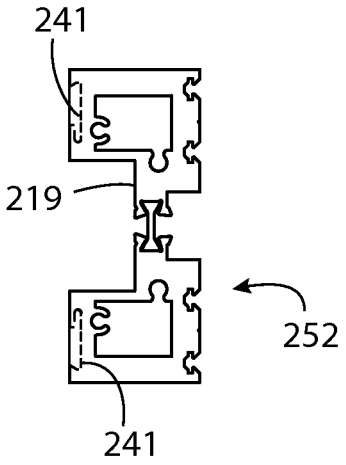
FIG. 44 shows a top view of a third alternative vertical marine glaze frame member 252. The slot 241 is hidden and represented by broken lines.
Figure 45:
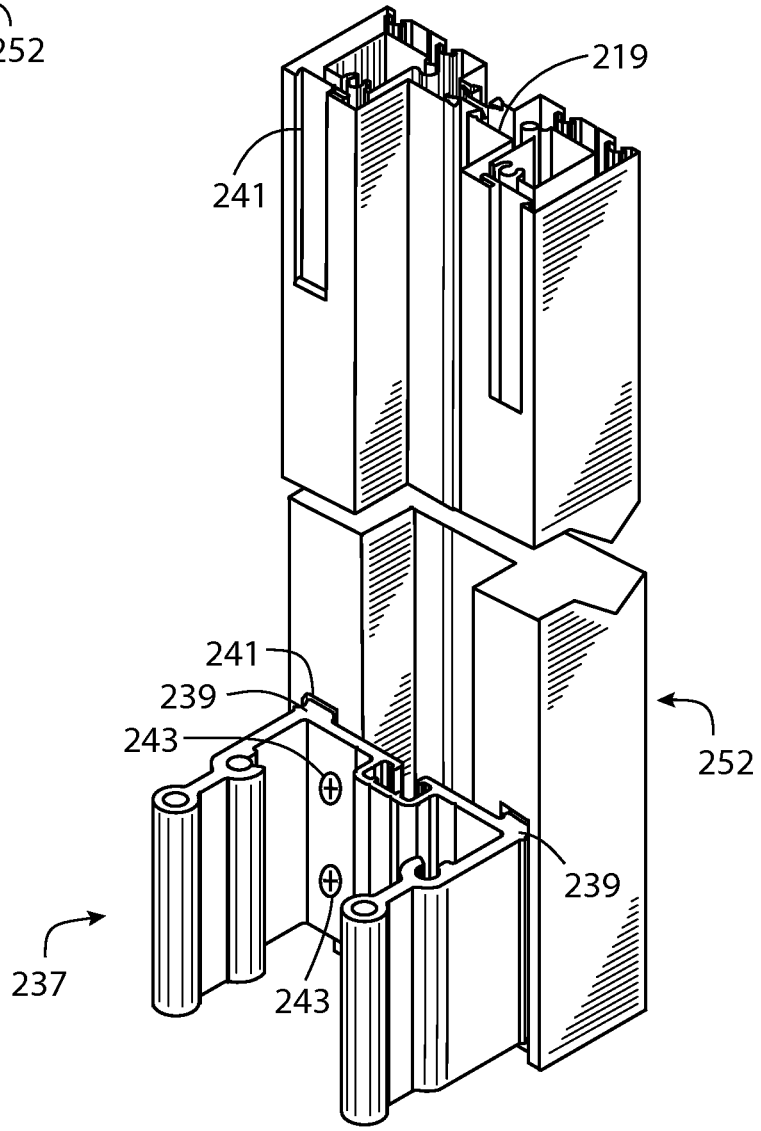
FIG. 45 shows a perspective detail view of the third alternative vertical marine glaze frame member 252 with a lug attached at one end and the mid portion cutaway to show both the upper and lower sections.

FIG. 44 shows a top view of a third alternative vertical marine glaze frame member 252. The slot 241 is hidden and represented by broken lines. FIG. 45 shows a perspective detail view of the third alternative vertical marine glaze frame member 252 with a lug 237 attached at one end. In FIGS. 44-45 both show the relationship between the u-shaped channel 219 and the third alternative vertical marine glaze frame member 252. This relationship essentially remains the same as previously described and illustrated.

Referring to FIG. 45, a slot is cut only in the ends of the third alternative vertical marine glaze frame member 252 rather than cut or extruded along its entire length. In FIG. 34, the ridges 239 of the lug 237 are slide into the slot 241. The slot can be cut to a specific length where the lug self-aligns into the proper position for the threaded fasteners 243 to be inserted. The arrangement between the slots 241 and the third alternative vertical marine glaze frame member 252 eliminates the need for the cover strips 249 as illustrated in FIG. 17-18.

A framed glazed door and wall structure has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. As an example, the vertical marine glaze frame member 207 described throughout this disclosure could be interchanged with alternative vertical marine glaze frame member 247, second alternative vertical marine glaze frame member 251, or the third alternative vertical marine glaze frame member 252, depending on the installation environment or desired end appearance. Similarly, it is possible to implement certain features described in single embodiments either separately or in combination in multiple embodiments. For example, the alternative lug 253 in combination with the alternative horizontal stop glaze frame member 255 can be substituted in implementations and methods that called for the lug 237 and horizontal stop glaze frame member 205. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A framed and glazed door or wall panel, comprising:

a glass panel;

a frame surrounding the glass panel comprising a pair of vertical marine glaze frame members and a plurality of setting blocks;

each vertical marine glaze frame member includes an inward facing unitary surface with a longitudinal detent forming a u-shaped channel that receives a corresponding vertical edge of the glass panel and seats the corresponding vertical edge of the glass panel against a corresponding one or more setting blocks of the plurality of setting blocks;

a first and second horizontal stop glaze frame members positioned on opposing horizontal edges of the glass panel and secured between each vertical marine glaze frame member of the pair of vertical marine glaze frame members; and the first and second horizontal stop glaze frame members each include a pair of glazing stops comprising longitudinally positioned removable rigid frame sections each with cushioning material positioned against corresponding opposing faces of the glass panel.

2. The framed and glazed door or wall panel of claim 1, further comprising structural glazing sealant along voids between each face of the glass panel and a corresponding inside edge of each longitudinal detent.

3. The framed and glazed door or wall panel of claim 1, further comprising:

a plurality of lugs; and the first and second horizontal stop glaze frame members each include a hollow interior end with corresponding opposing interior vertical sides that receive and engage corresponding opposing exterior vertical sides of a corresponding lug of the plurality of lugs, the corresponding lug engages and secures to an end portion exterior surface of a corresponding adjacent vertical marine glaze frame member.

4. A method for assembling a framed and glazed door or wall panel, comprising:

securing a pair of horizontal stop glaze frame members to opposing ends of a first vertical marine glaze frame member, a setting block within a first detent positioned longitudinally along a unitary surface of the first vertical marine glaze frame member, and glazing stops comprising longitudinally positioned removable rigid frame sections to each horizontal stop glaze frame member of the pair of horizontal stop glaze frame members in combination with cushioning material, the combination of horizontal stop glaze frame members, vertical marine glaze frame members, and glazing stops forming a three-sided frame sub-assembly open on one end;

setting a glass panel in the three-sided frame sub-assembly so that a vertical glass edge rests directly against the setting block within the first detent and a face of the glass panel along opposing horizontal edges seats directly to corresponding glazing stops in combination with the cushioning material;

attaching and securing a second vertical marine glaze frame member and second setting block combination to the pair of horizontal stop glaze frame members of the three-sided frame sub-assembly so that an opposing vertical glass edge rests directly against the second setting block within a second detent longitudinally positioned along a second unitary surface of the second vertical marine glaze frame members; and securing a second pair of glazing stops comprising a removable rigid frame sections with corresponding cushioning material, longitudinally along and to the pair of horizontal stop glaze frame members so that a second pair of glazing stops in combination with the cushioning material directly contacts an opposing face of the glass panel along horizontal face edges.

5. The method of claim 4, wherein:

securing the pair of horizontal stop glaze frame members to opposing ends of the first vertical marine glaze frame member includes inserting a lug secured to a first vertical marine glaze frame member face into a hollow interior portion of a horizontal stop glaze frame member of the pair of horizontal stop glaze frame members thereby creating a rigid corner joint.

6. The method of claim 4, further comprising:

filling a gap between each the face along opposing vertical edges of the glass panel and corresponding inside edges of the first and second detents with structural glazing sealant.

* * * * *